US006505666B1

(12) United States Patent
Anderson et al.

(10) Patent No.: US 6,505,666 B1
(45) Date of Patent: Jan. 14, 2003

(54) SHAFT SUPPORT FOR VERTICAL BLINDS

(75) Inventors: Richard N. Anderson, Whitesville, KY (US); Eugene W. Thompson, Maceo, KY (US)

(73) Assignee: Hunter-Douglas, Inc., Upper Saddle River, NJ (US)

( * ) Notice: Subject to any disclaimer, the term of this patent is extended or adjusted under 35 U.S.C. 154(b) by 0 days.

(21) Appl. No.: 09/920,030

(22) Filed: Aug. 1, 2001

Related U.S. Application Data

(60) Provisional application No. 60/228,225, filed on Aug. 25, 2000.

(51) Int. Cl.[7] ..... E06B 9/30
(52) U.S. Cl. ..... 160/173 V; 160/178.1 V
(58) Field of Search ..... 160/173 V, 168.1 V, 160/176.1 V, 177 V, 178.1 V, 900

(56) References Cited

U.S. PATENT DOCUMENTS 4,662,422 A * 5/1987 Anderson ..... 160/168.1 R
4,802,522 A * 2/1989 Anderson ..... 160/168 R
4,848,434 A * 7/1989 Morris et al. ..... 160/168.1 R
6,135,188 A * 10/2000 Anderson et al. ..... 160/178.1 V
6,325,132 B1 * 12/2001 Anderson et al. ..... 160/173 V

FOREIGN PATENT DOCUMENTS

DE 36 20 038 5/1995

* cited by examiner

*Primary Examiner*—David M. Purol
(74) *Attorney, Agent, or Firm*—Theresa Fritz Camoriano; Guillermo Camoriano

(57) ABSTRACT

A shaft support for vertical blinds wherein a swing arm automatically extends to span the head rail space in order to support the cords and tilt rod in the head rail as the carrier assembly retracts to open the blind. This swing arm automatically stows away along the head rail when the carrier assembly extends to close the blind so as not to interfere with the motion of the carrier assembly. The automatic operation of this shaft support is such that the mechanism is self correcting in the event that it is installed incorrectly or that it is accidentally moved to an incorrect position during operation.

9 Claims, 25 Drawing Sheets

Fig. 8
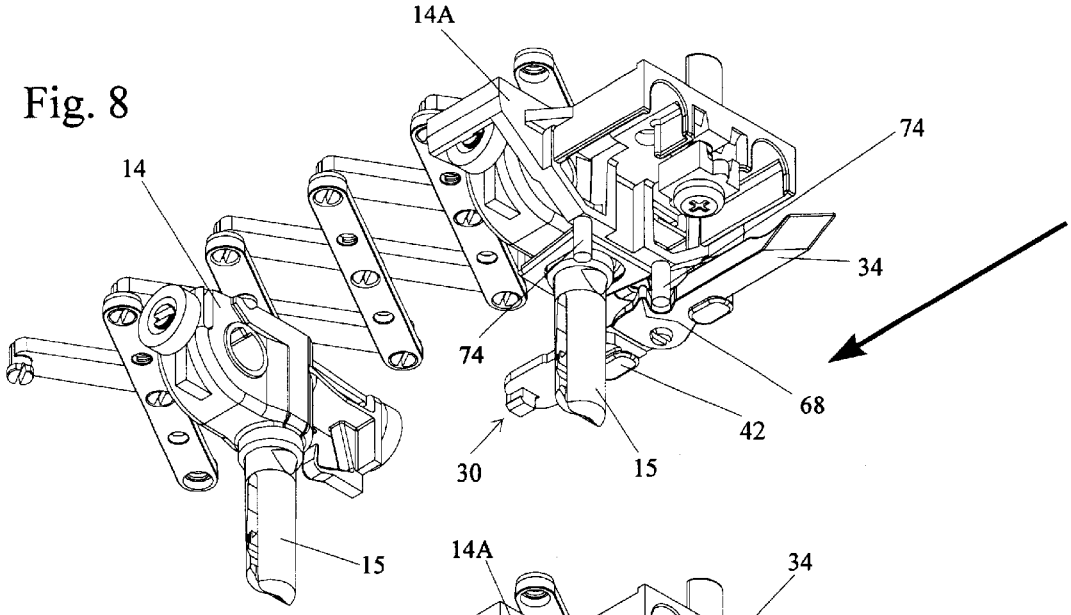
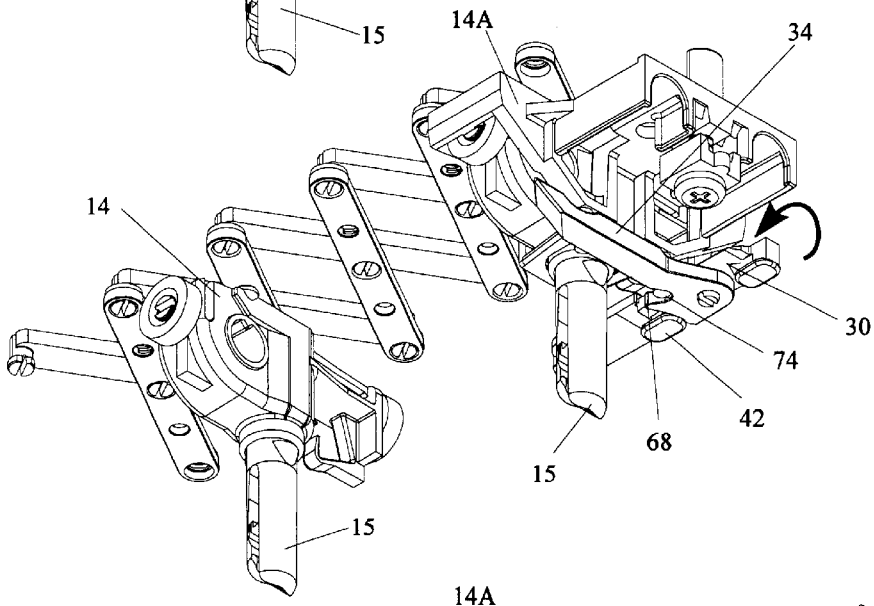
Fig. 9
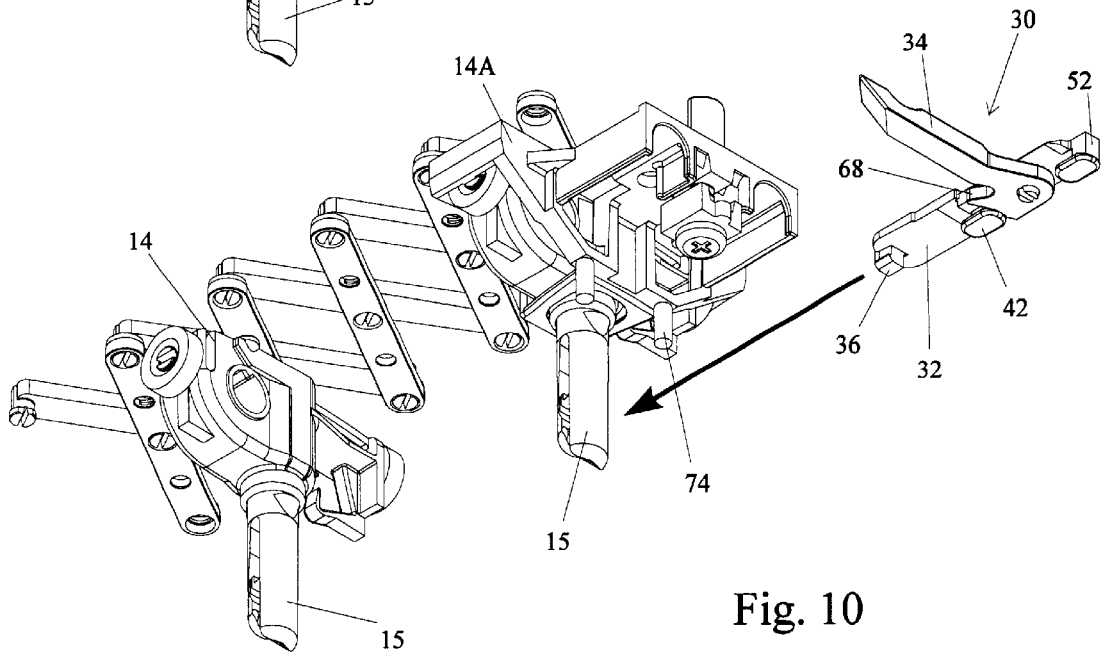
Fig. 10

Fig. 11
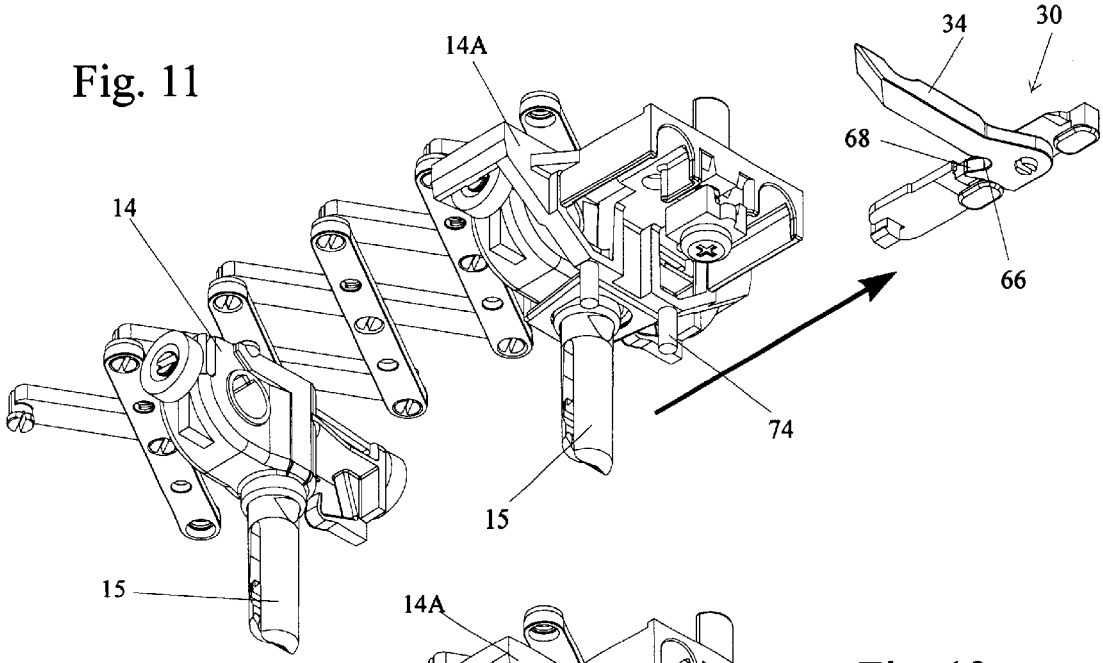
Fig. 12
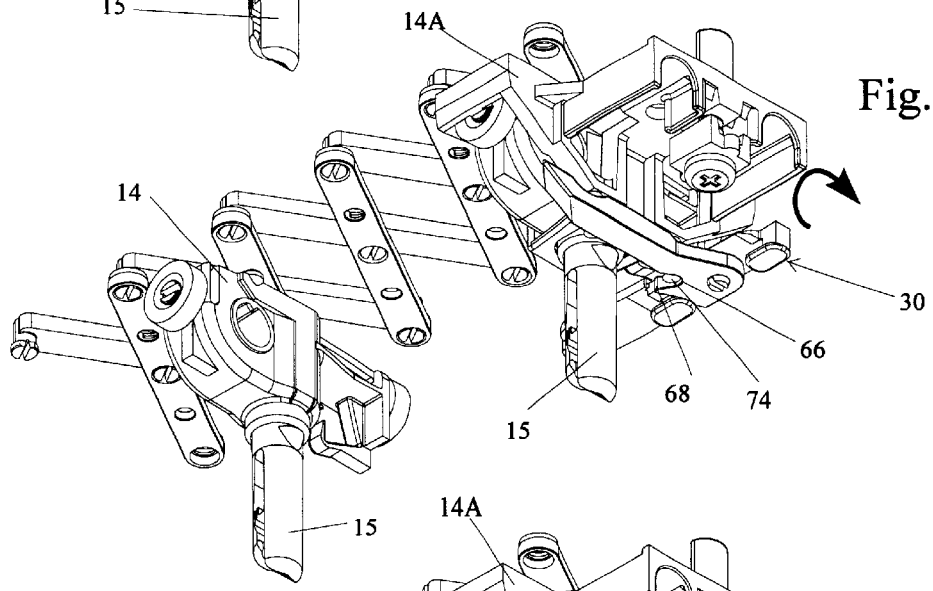
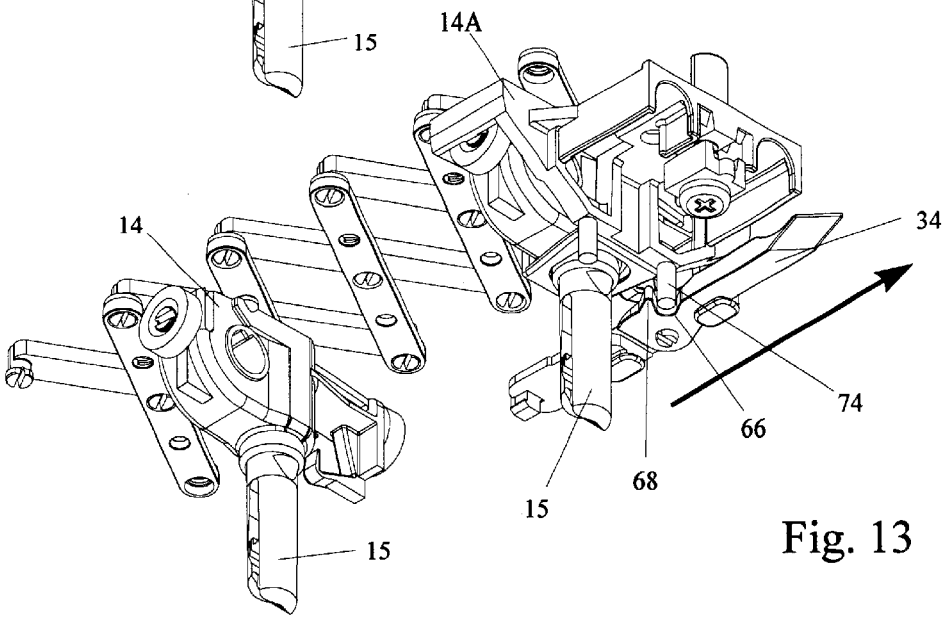
Fig. 13

Fig. 17
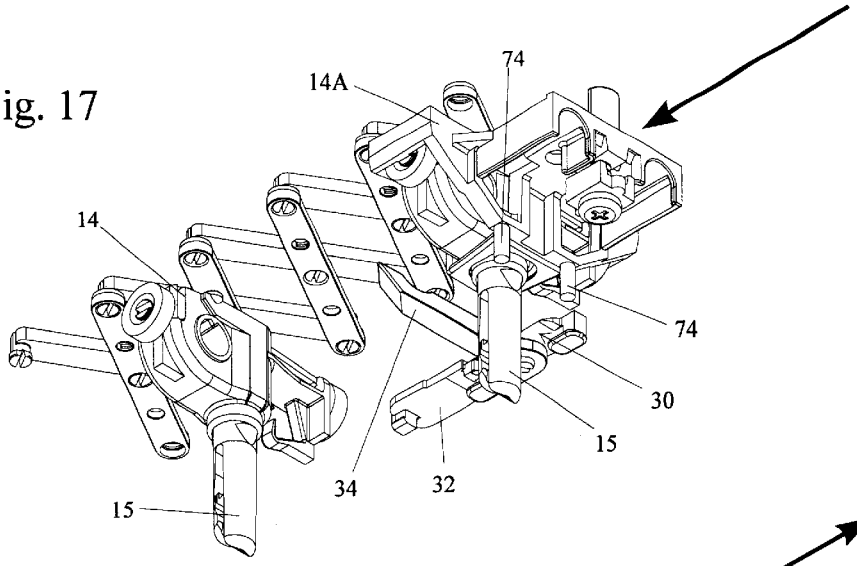
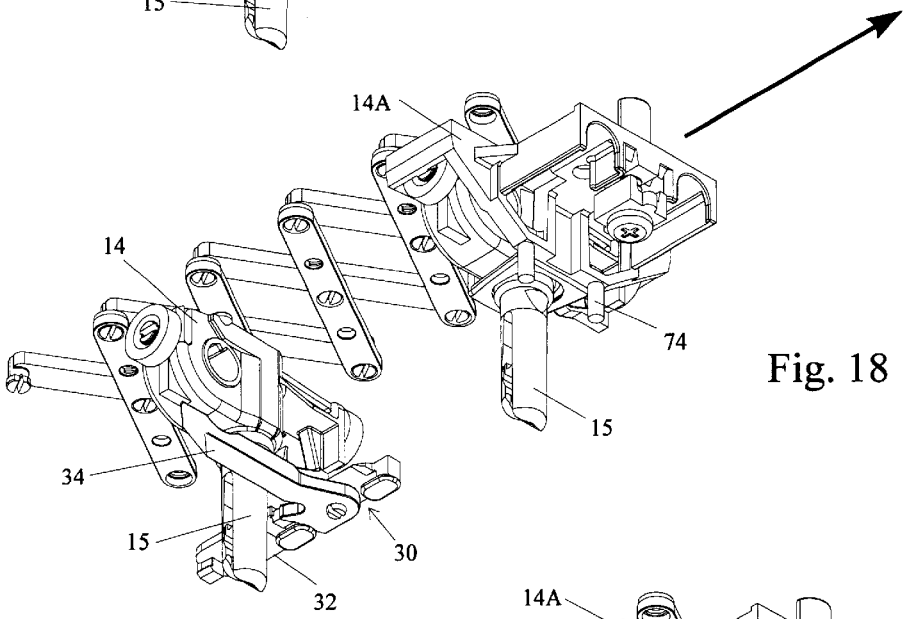
Fig. 18
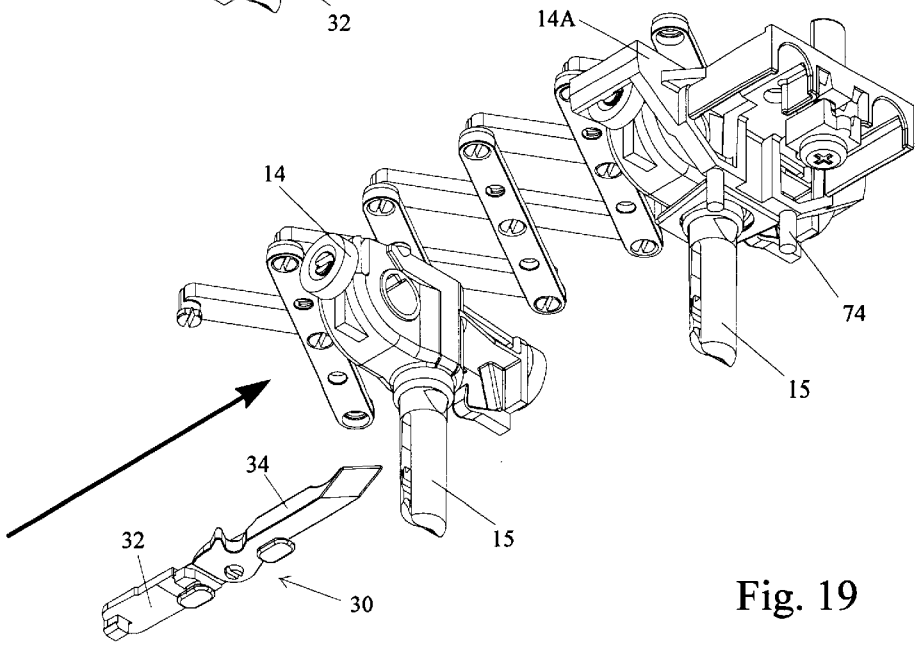
Fig. 19

Fig. 44
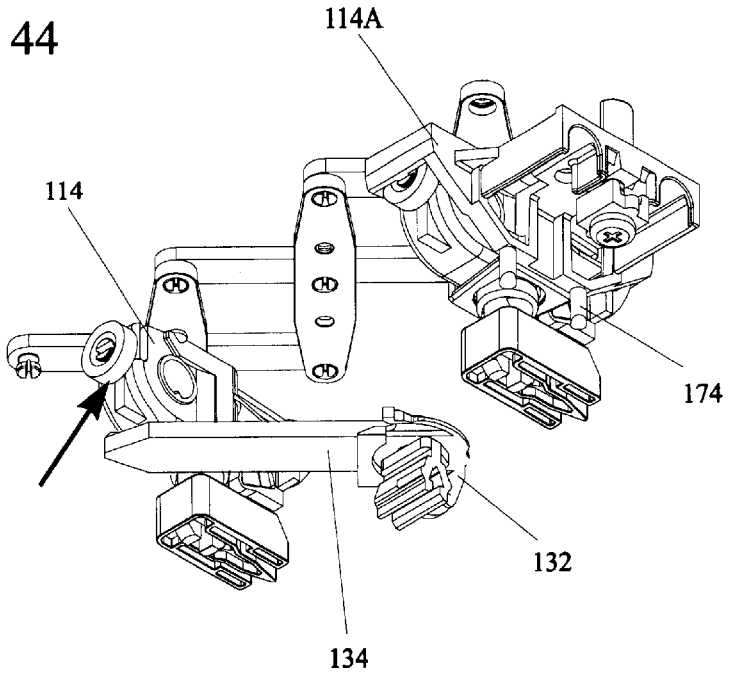
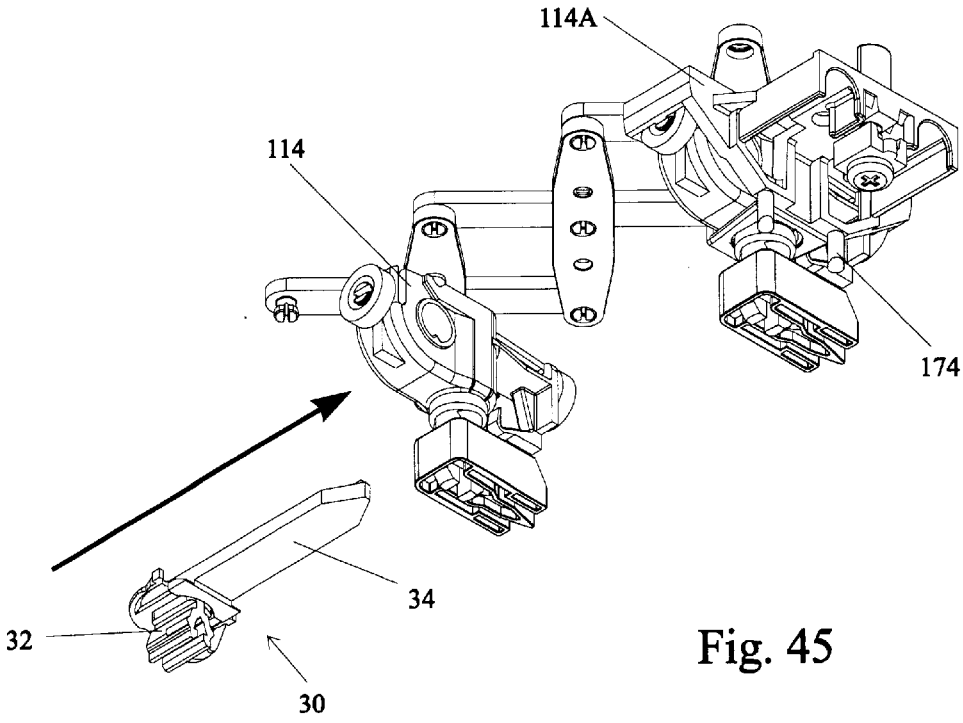
Fig. 45

Fig. 50
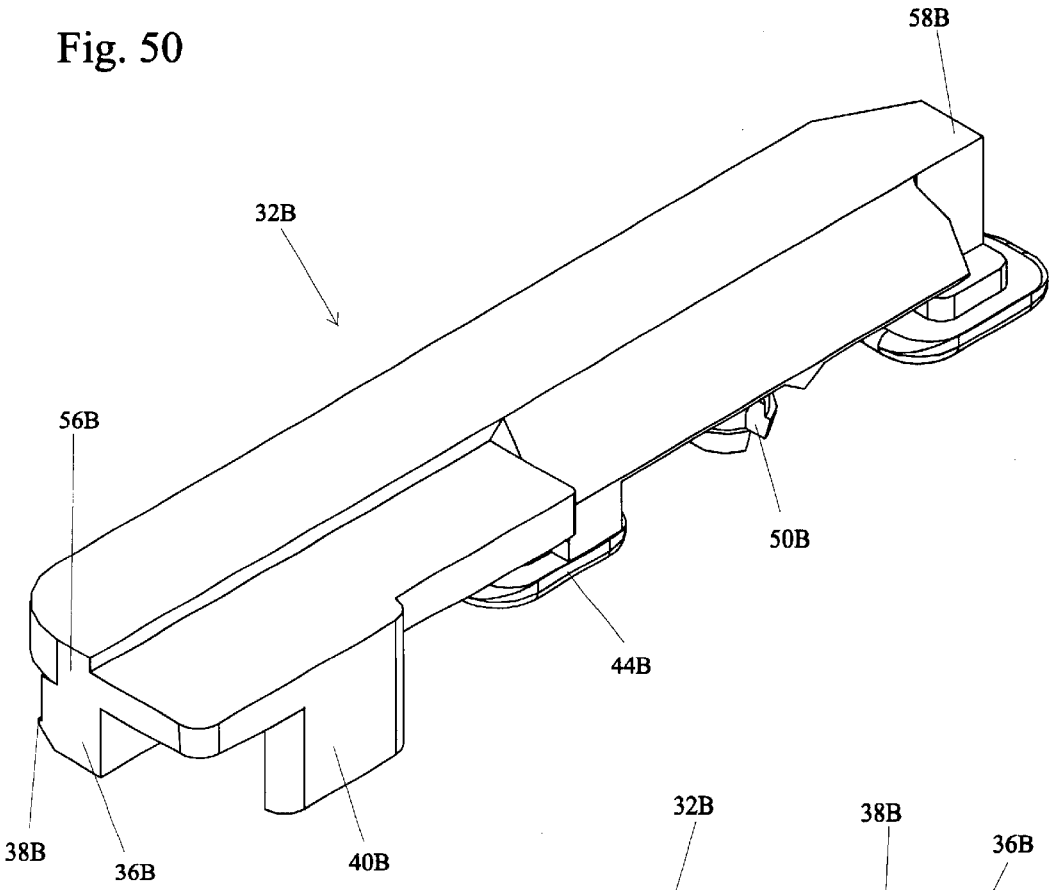
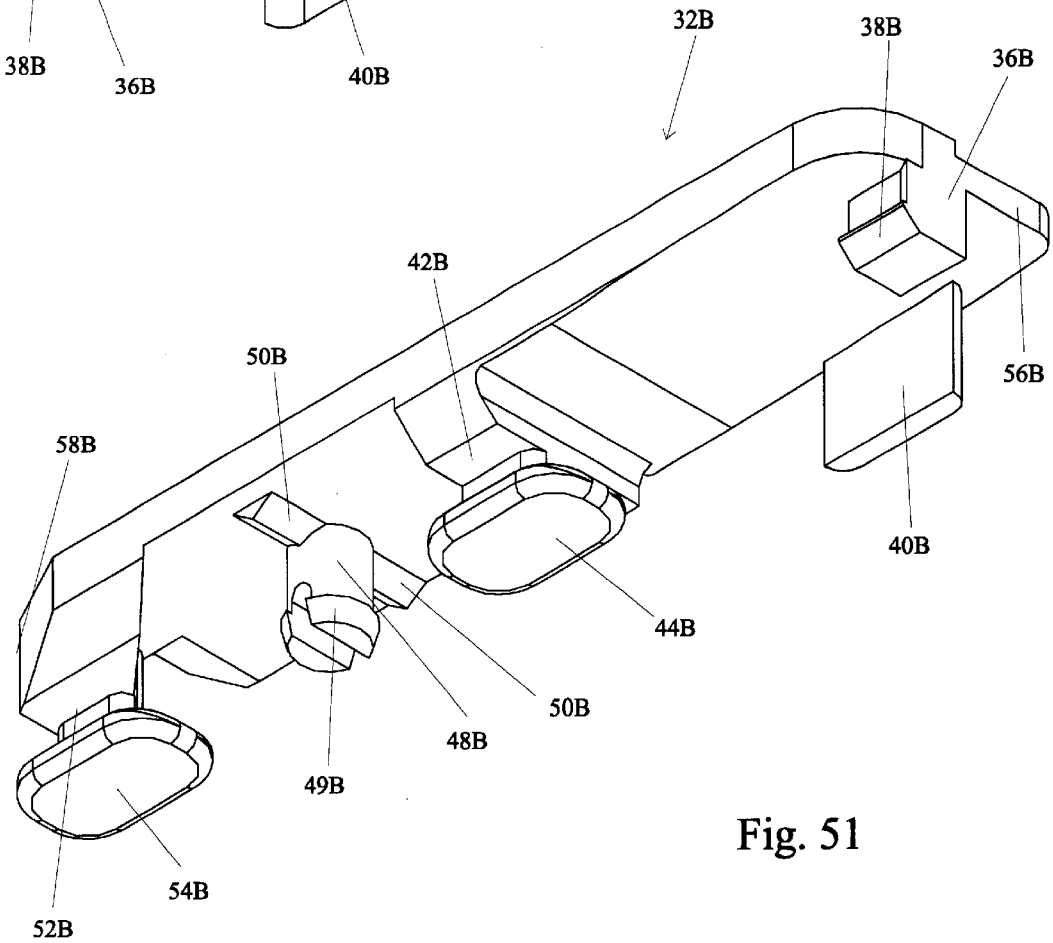
Fig. 51

SHAFT SUPPORT FOR VERTICAL BLINDS

This application claims priority from U.S. provisional application No. 60/228,225, filed August 25, 2000.

BACKGROUND OF THE INVENTION

The present invention relates to a support arm which automatically swings into position to support the cords and tilt rod in the head rail of a vertical blind as the carrier assembly traverses to open the blind (retracts). As the carrier assembly traverses to close the blind (extends), the support arm automatically swings out of the way so as not to interfere with the motion of the carrier assembly.

Typically, a vertical blind transport system will have a top head rail, which both supports the blind and hides the mechanisms that are used to traverse the vanes and the mechanisms that are used to tilt the vanes. The carrier assembly is fully supported along its entire sliding length, as each carrier must be able to support the weight of its corresponding vane. Thus, when the carrier assembly extends, it assists in supporting both the tilt rod and the traverse cords. However, as the vanes traverse open, the tilt rod and the traverse cords remain behind and are thus unsupported except at one end by the head rail and at the other end by the lead carrier which is retreating, leaving an ever-widening unsupported span. The traverse cords, and even the tilt rod, tend to drape down through this unsupported span and stick out past the open bottom of the head rail. This is unsightly and may cause operational problems.

The prior art has support arms which, when properly installed, swing across the head rail as the lead carrier retreats, so as to provide a support for the sagging traverse cords and tilt rod. These support arms swing away, back to a stowed position, when the lead carrier is traversing closed and can thus take over the support function otherwise afforded by the support arm.

However, if the prior art support arm is in an incorrect position as the carrier assembly is traversing, the support arm will be rendered ineffective. In one instance, if the support arm is in the stowed position as the carrier assembly traverses to the closed position (extends), the lead carrier will impact upon and will not move past the support arm, causing the carrier train to lock up. If the operator uses extreme force to overcome the lock-up, the carrier train will push the support arm to the end of the head rail leaving the support arm inoperative. In the second instance where the support arm is in the "spanning position"(not stowed position) as the carrier assembly traverses to the open position (retracts), the first carrier to come across the support arm will simply drag the support arm with it. The holding force of the support arm is not enough to cause the operator to stop traversing the blind. The support arm is forcibly moved along with the carrier train into an ineffective position, where it remains.

SUMMARY OF THE INVENTION

The present invention provides a support arm design which has the advantages of prior art support arms, plus it eliminates the problems with prior art support arms which may become inoperative or ineffective if improperly installed or if they are accidentally moved to an improper position during normal operation.

In the current invention, as the carrier assembly retracts, the lead carrier activates the support arm, swinging it into the spanning position so as to support the traverse cords and the tilt rod. As the carrier assembly extends, the lead carrier stows the support arm so that it does not interfere with the carrier train. Should the support arm be in the incorrect position, so that it is stowed when it should be spanning, the design of the present invention allows for the support arm and the carrier assembly to "bypass" each other, and yet be ready to properly cooperate with each other to engage the support arm in the right place and at the right time the next time the carrier assembly traverses the blind.

The support arm assembly has a ramp, and, in the event that the support arm is already in the stowed position when the carrier assembly is extending (when the support arm should have been in the spanning position instead of the stowed position), the lead carrier guide activating post will move up and over the support arm ramp to bypass the support arm, but will activate the arm when it passes back (retracts) during the next cycle. In the event that the support arm is already in the spanning position when the carrier assembly is retracting (when the support arm should have been in the stowed position instead of the spanning position), the support arm will bring the carrier train to a complete stop. The holding force of the support arm is strong enough to stop the carrier train and to cause the operator to traverse the blind back to the closed position, which will cause the next carrier to reset the support arm to the correct, stowed position.

BRIEF DESCRIPTION OF THE DRAWINGS

FIG. 8 is a broken away perspective view of the carrier train of FIG. 1 as it traverses open (retracts) and just prior to activating the support arm;

FIG. 9 is the same view as FIG. 8, except that the carrier train has retracted far enough to activate the support arm such that the support arm spans the head rail;

FIG. 10 is the same view as FIGS. 8 and 9, except that the carrier train has retracted even further, leaving behind the support arm in the activated position, spanning the head rail opening;

FIG. 11 is the same view as FIG. 10, as the carrier train starts traversing back to the closed position (extending), showing the support arm in the activated position spanning the head rail;

FIG. 12 is the same view as FIG. 11, except that the carrier train has extended to the point where it is just ready to engage the support arm so as to swing it to the stowed position;

FIG. 13 is the same view as FIGS. 11 and 12, except that the carrier train has extended even further, leaving behind the support arm in the stowed position, no longer spanning the head rail opening;

FIG. 17 is a broken away perspective view of the carrier train of FIG. 1 as it retracts, just prior to encountering the support arm in an incorrect, spanning position when it should be in the stowed position;

FIG. 18 is the same view as FIG. 17, showing how a second carrier is about to engage the support arm, which is in an incorrect, spanning position, so as to place it in its correct, stowed position;

FIG. 19 is the same view as FIGS. 17 and 18, showing how the second carrier has swung the support arm into its correct, stowed position;

FIG. 44 is the same view as FIG. 42 but showing how the second carrier is about to engage the swing arm to finish its rotation to the fully and correct stowed position;

FIG. 45 is the same view as FIGS. 42 and 44, but showing how the second carrier has swung the support arm into its correct stowed position;

FIG. 50 is a perspective view of the top of an alternate embodiment of the base portion of a support arm;

FIG. 51 is a perspective view of the bottom of the base of FIG. 50;

DESCRIPTION OF THE PREFERRED EMBODIMENTS

Figure 1:
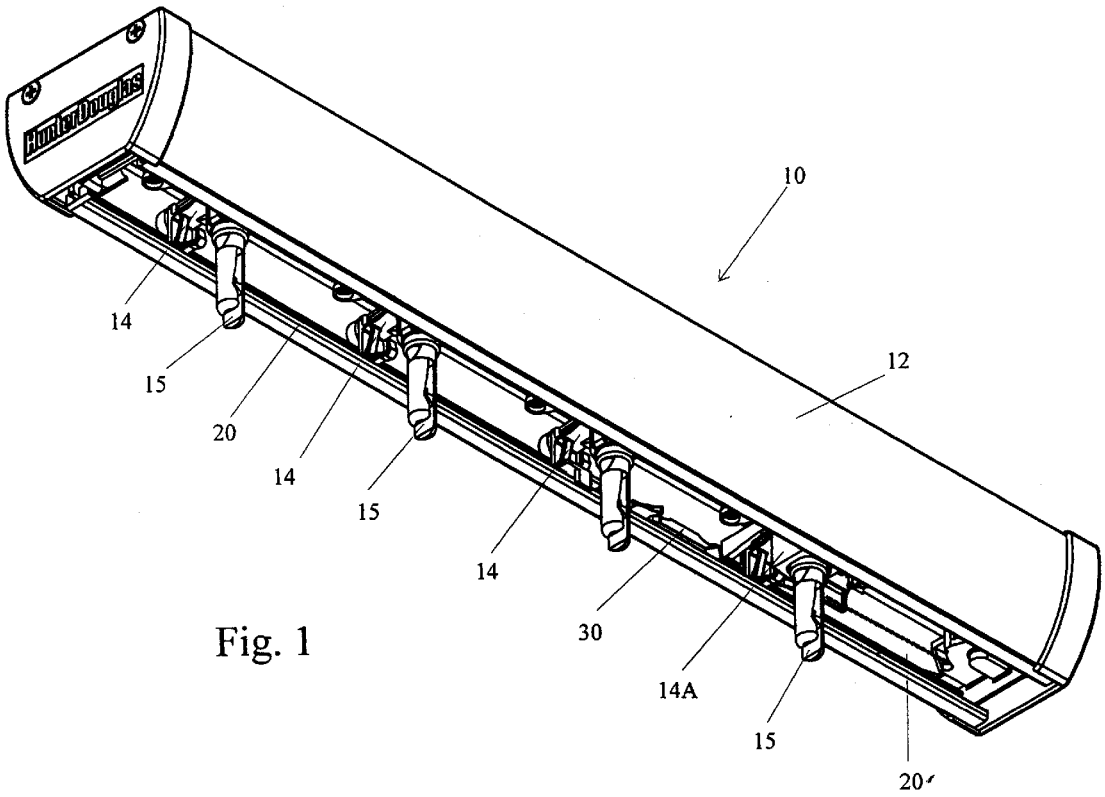
FIG. 1 is a perspective view of a vertical blind head rail mechanism incorporating a support arm made in accordance with the present invention, shown in the position when the carriers have traversed to the closed position.
Figure 3:
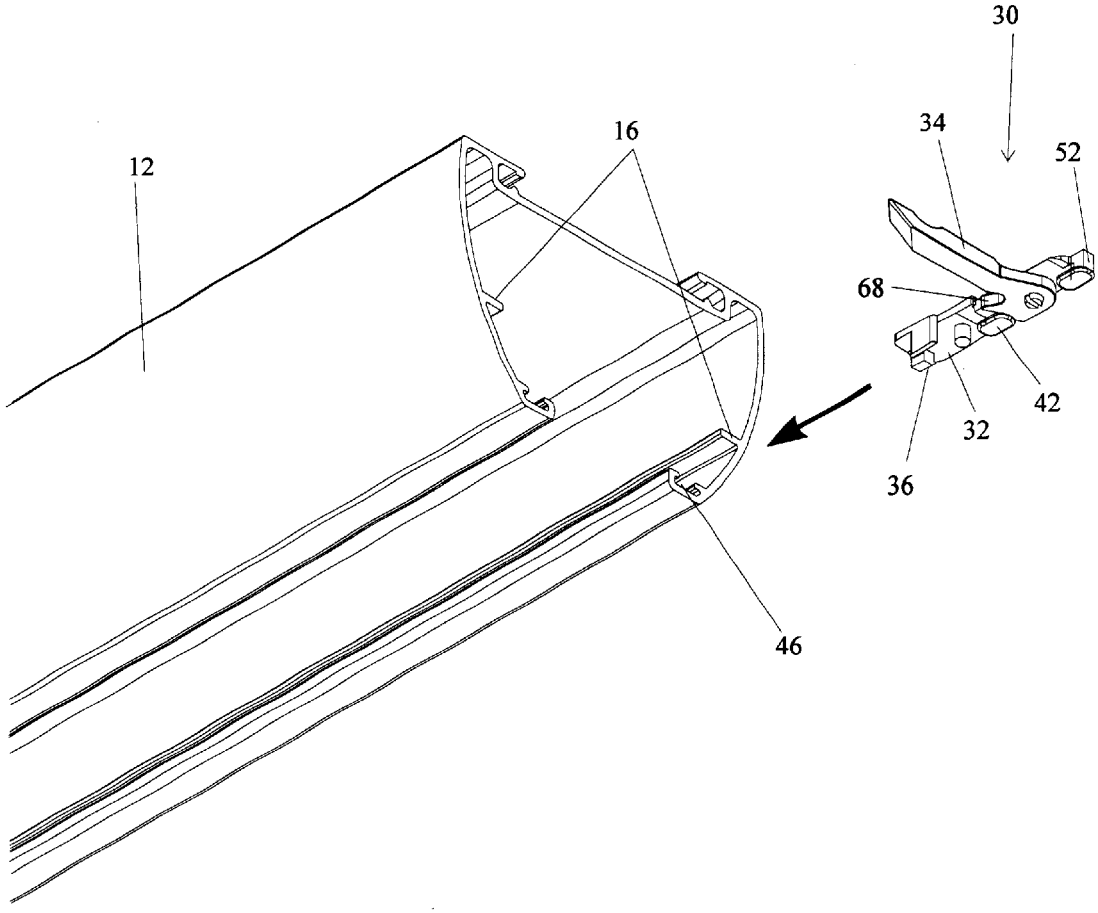
FIG. 3 is a partially broken away, exploded perspective view of the support arm and the head rail of FIG. 2.

Referring to FIG. 1, the blind 10 includes a head rail 12, and a plurality of vanes (not shown) suspended from the head rail 12 by means of carriers 14 on a carrier train that rides on and is supported by an internal profile 16 (See FIG. 3) of the head rail 12. A tilt rod 18 runs through, and is supported by, the carrier train. As the tilt rod 18 is rotated, it causes carrier hooks 15 on the carriers 14 to rotate and thus "tilt" the vanes open or closed, as is known in the art. Also running in the head rail 12 space are the traverse cords 20, which are used to traverse the carrier train open (retracted) and closed (extended).

When the vanes are traversed closed (extended), as shown in FIG. 1, the carrier train itself supports both the tilt rod 18 and the traverse cords 20 such that they are held in place within the head rail 12 space and they do not droop below the open bottom of the head rail 12 space to become unsightly and possibly cause operational problems. A support arm 30 may therefore safely be stowed away, parked along the side of the head rail 12, out of the way of the carrier train.

Figure 2:
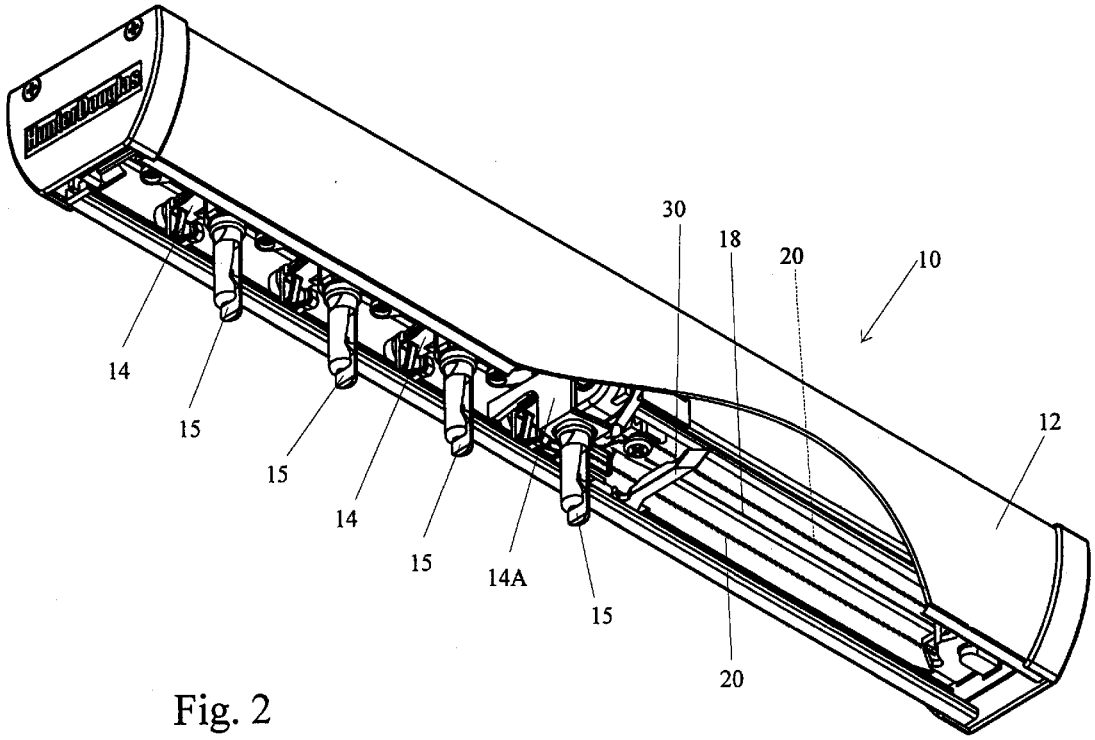
FIG. 2 is a perspective view, partially broken away, of the vertical blind head rail mechanism of FIG. 1 with a support arm in the spanning position as the carriers have traversed to the open position.

When the vanes are traversed open (retracted), as shown in FIG. 2, the lead carrier 14A retreats, leaving a progressively longer unsupported gap through which the traverse cords 20, and even the tilt rod 18 may droop. To avoid this condition, the support arm 30 is swung into its spanning position, by the lead carrier 14A, across the bottom portion of the head rail 12. As the lead carrier 14A retreats further, the support arm 30 remains behind, spanning the head rail 12, and providing a support for the traverse cords 20 and the tilt rod 18, to prevent them from drooping below the head rail 12 space.

Figure 14:
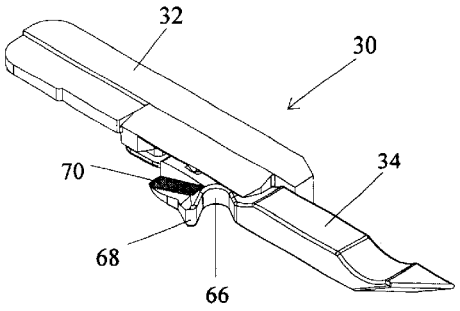
FIG. 14 is a perspective view of the support arm depicted in all the previous figures, clearly showing the ramp used to allow the lead carrier in the carrier train to "bypass" the support arm when the support arm is incorrectly in the stowed position when it should be in the spanning position.
Figure 24:
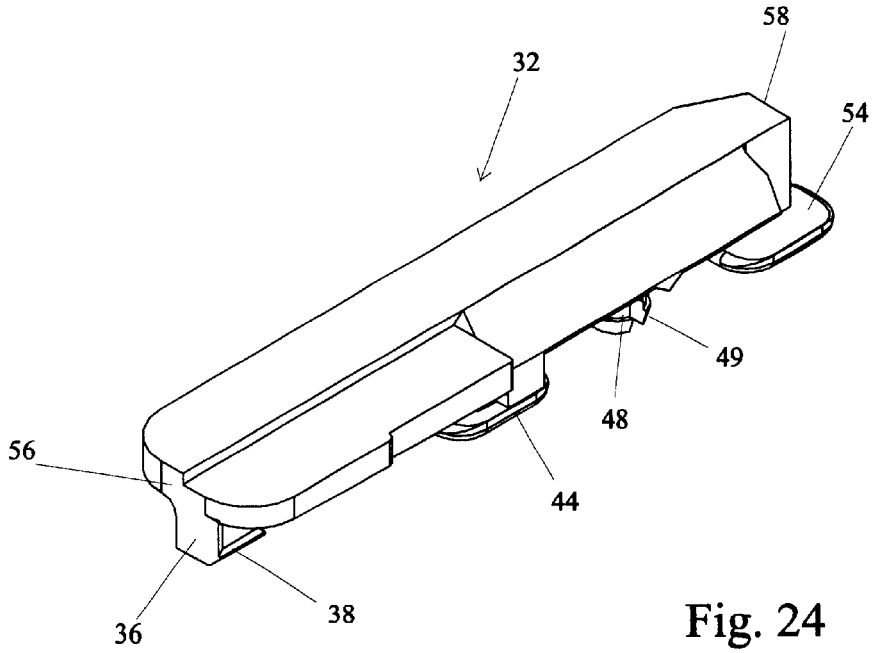
FIG. 24 is a perspective view of the top of the base portion of the support arm mechanism of FIG. 14.
Figure 25:
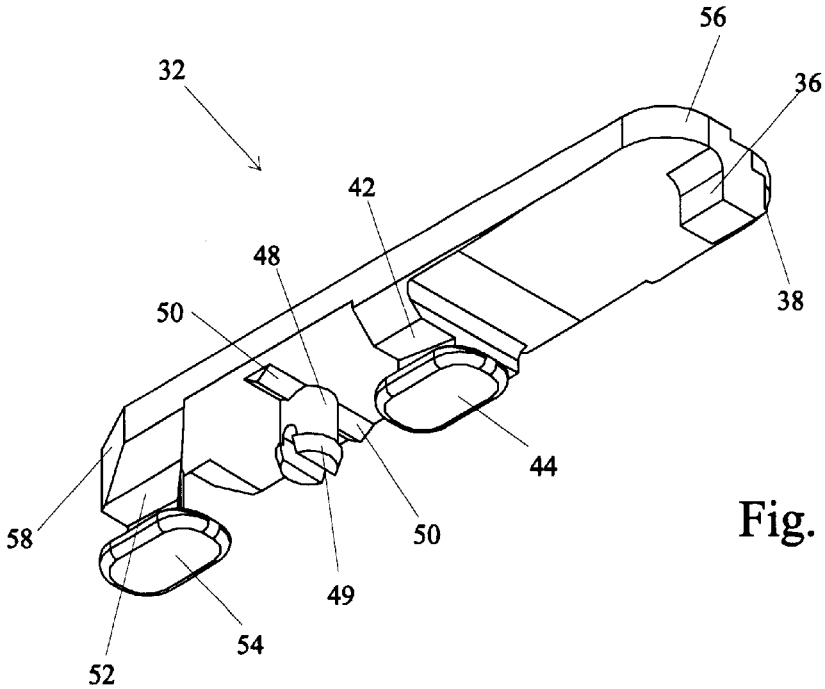
FIG. 25 is a perspective view of the bottom of the base of FIG. 24.
Figure 26:
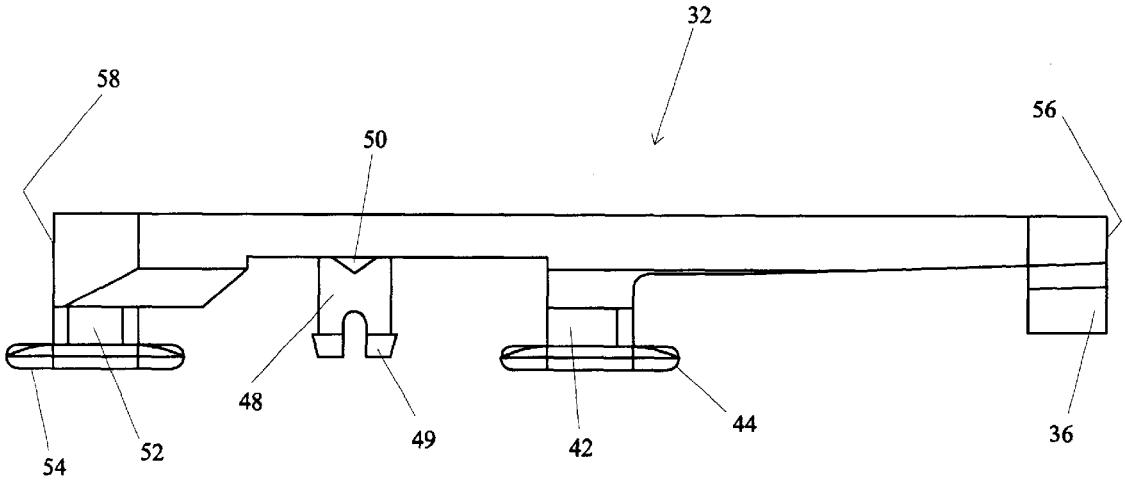
FIG. 26 is a side view of the base of FIG. 24.

Referring now to FIG. 14, the support arm mechanism 30 includes a mounting base 32 and a swing arm 34, which pivots relative to the base 32. FIGS. 24, 25, and 26 show the mounting base 32 in greater detail. The mounting base 32 is a substantially rectangular piece which is relatively flat on its top surface and which has four appendages projecting from its bottom surface.

The first of the appendages 36 is located at a first end 56 of the mounting base 32 and approximately on the longitudinal centerline of the base 32, and it has a small barb 38 on its unattached end, which is used to lock the mounting base onto the head rail 12 with an interference fit, as will be explained later. This first appendage 36 also serves to locate the mounting base 32 relative to the head rail 12.

Figure 4:
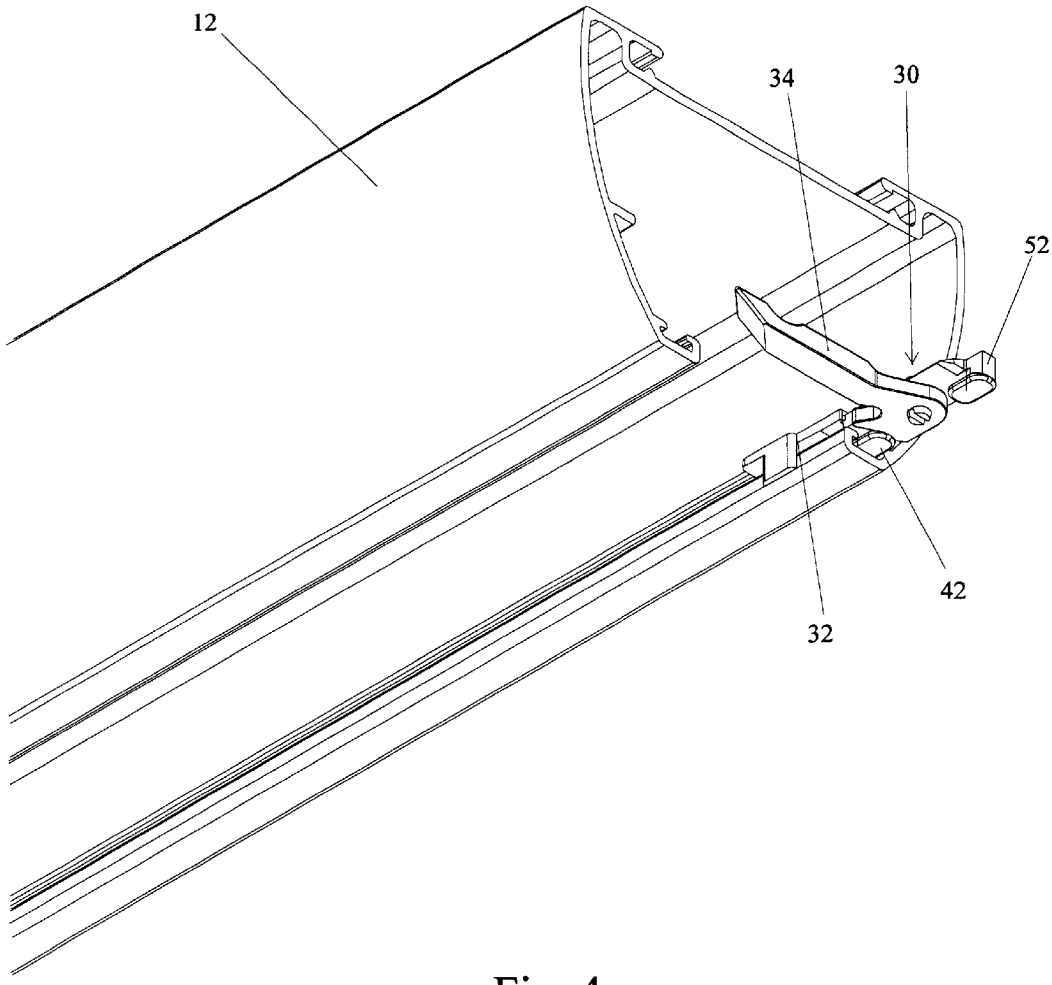
FIG. 4 is the same view as FIG. 3, but with the support arm partially inserted into the head rail.
Figure 5:
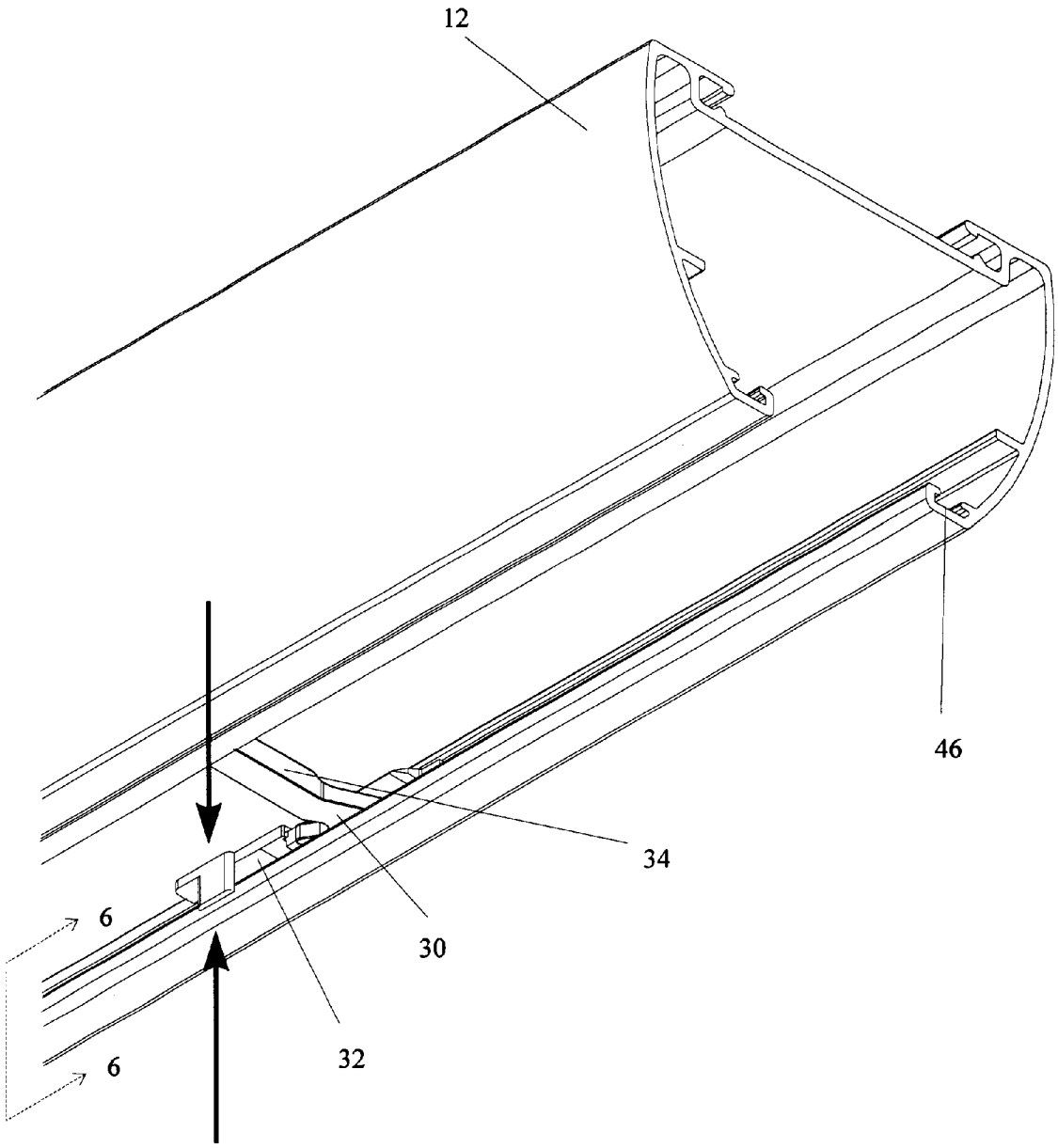
FIG. 5 is the same view as FIG. 4, but showing the support arm finally secured to the head rail.
Figure 6:
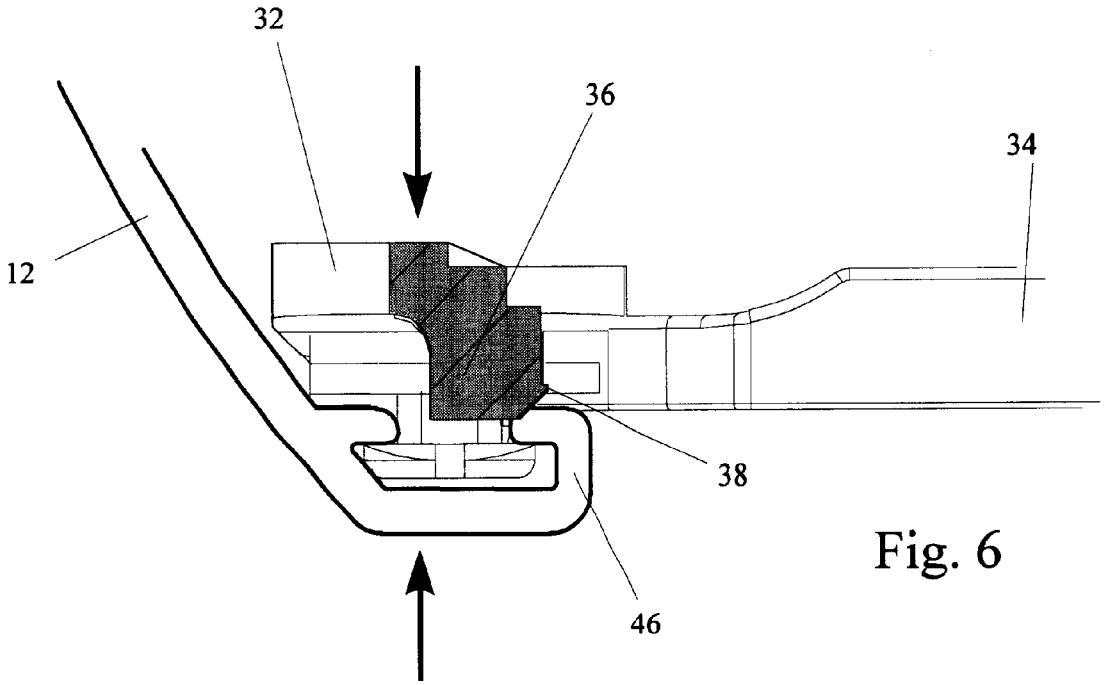
FIG. 6 is a broken away sectional view along line 6—6 of FIG. 5, showing the support arm before it has been finally secured to the head rail.
Figure 7:
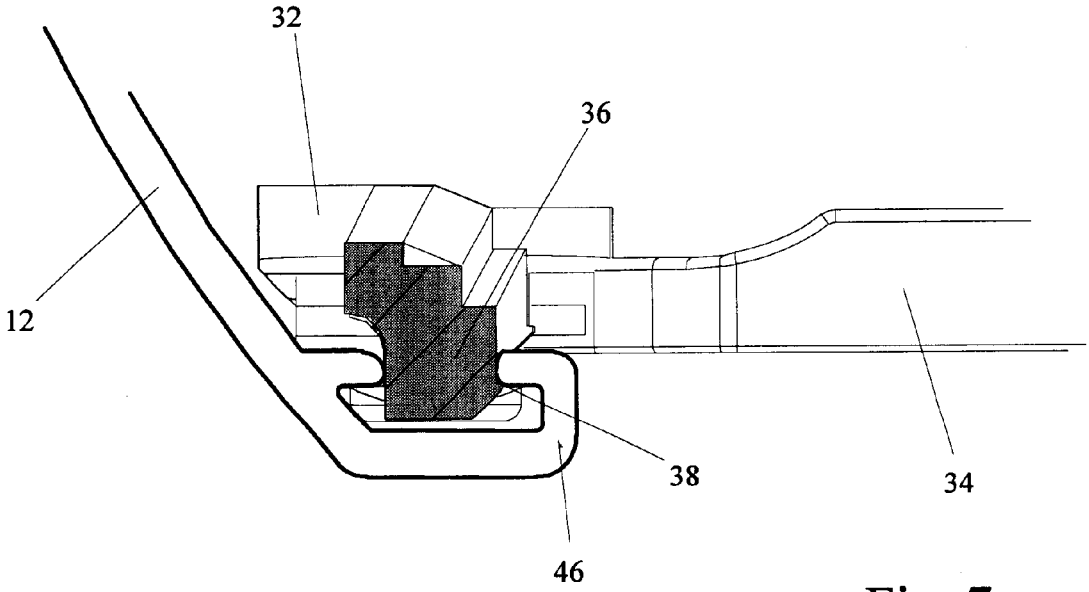
FIG. 7 is the same view as FIG. 6, but showing the support arm after it has been finally secured to the head rail.

The second appendage 42, like the first appendage 36, is aligned with the longitudinal centerline of the base 32. It is located approximately halfway between the first and second ends 56, 58 of the base 32 and is mushroom-shaped with a flat cap 44 used to hold the mounting base 32 in the "U" shaped channel profile 46 of the head rail 12 (See FIGS. 3–5). This appendage 42 also provides a stop for the swing arm 34 when moving to the spanning position, and, as will be explained later, this second appendage 42 is also instrumental in locking the support arm 30 to the head rail 12 when the swing arm is incorrectly in the spanning position and the carrier train is retracting.

The third appendage 48 is located approximately halfway between the second appendage 42 and the second end 58 of the base 32, and it is aligned with the longitudinal centerline of the base 32. It is a short cylinder with flared out, tapered flanges 49 at its unattached end for the purpose of securing the swing arm 34, as will be described later. A small ridge 50 with a triangular profile runs perpendicular to the longitudinal centerline of the base 32, at the attached end of this appendage 48, the purpose of which is also explained later. This cylindrical appendage 48 is longer than the thickness of the swing arm 34, but shorter than the distance from the mounting base 32 to the flat cap 44 of the second appendage 42.

A fourth appendage 52 is located at the second end 58 of the base 32 and is also aligned with the longitudinal centerline of the base 32. Like the second appendage 42, it is mushroom-shaped with a flat cap 54, which fits in the "U" shaped channel profile 46 of the head rail 12 (See FIGS. 3–5). This appendage 52 also provides a stop for the swing arm 34 when moving to the stowed position.

Figure 27:
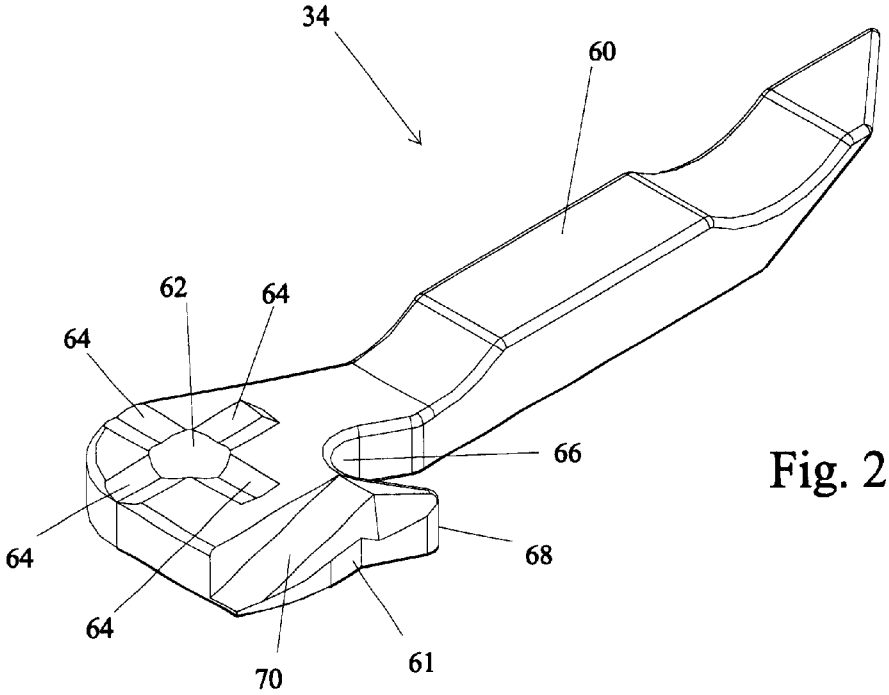
FIG. 27 is a perspective view of the top of the swing arm portion of the support arm of FIG. 14.
Figure 28:
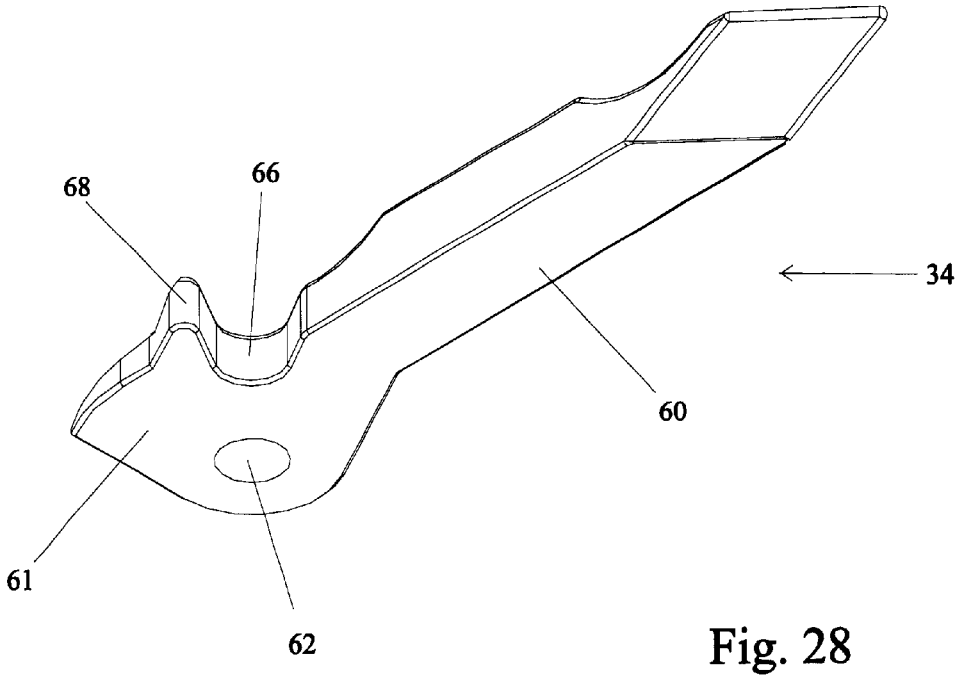
FIG. 28 is a perspective view of the bottom of the swing arm of FIG. 27.

FIGS. 27 and 28 show the swing arm portion 34 of the support arm mechanism 30. The swing arm 34 is L-shaped, including a major, long arm portion 60, which actually spans across the head rail 12 and a lateral projection or short arm 61 extending perpendicular to the major long arm portion 60 at one end. There is a pivot point hole 62 at the intersection of the two arms 60, 61 of the "L".This pivot point hole 62 has an inside diameter just slightly larger than the outside diameter of the third appendage 48 of the mounting base 32, such that this third appendage 48 snaps into the hole 62 of the swing arm 34, allowing the swing arm 34 to swing from the stowed to the spanning position and back. The tapered flanges 49 on the third appendage 48 get squeezed together as the pivot point hole 62 passes over them, and then snap back out effectively pivotally securing the swing arm 34 in place. There are four shallow depressions 64 on the upper surface of the swing arm 34 extending from the pivot point hole 62, and running parallel to both legs 60, 61 of the "L" shaped swing arm 34. These shallow depressions 64 have a triangular profile, which matches the triangular profile of the ridges 50 found at the attached end of the third appendage 48. Thus, when the swing arm 34 pivots around this third appendage 48, there are two positions, corresponding to the fully stowed and the fully spanning positions of the swing arm 34, when the ridges 50 mate with the shallow depressions 64 to secure the swing arm 34 in place. An extra measure of force is required to break loose the swing arm 34 from the secured position, and the swing arm 34 will tend to remain in one of these two secured positions, thus helping to ensure that the swing arm 34 is either fully stowed or fully spanning across the head rail 12.

At the inner corner of the intersection of the two legs 60, 61 of the "L" shaped swing arm 34 there are a recess 66 and a tip 68. At the end of the lateral projection or short leg 61 of the "L" shaped swing arm 34, and running parallel to the major portion of long leg 60 on the top surface of the swing arm 34, there is a ramp 70, which has a minimum thickness at the outer edge of the short leg and a maximum thickness at the inner edge where it meets the recess 66 and the tip 68.

The swing arm 34 is mounted onto the mounting base 32 by snapping the pivot point hole 62 over the flared out flanges 49 of the third appendage 48, so that the upper face of the swing arm 34 (with the depressions 64) is in contact with the lower face of the mounting base 32 (with the ridges 50). As the swing arm 34 bottoms out on the third appendage 48, the flared out flanges 49 spring back out just enough to secure the swing arm 34 onto the third appendage 48, while still allowing the swing arm 34 to swing around its pivot point hole 62 from a stowed to a spanning position and back again. While in the fully stowed position (as in FIG. 14), the major, long leg 60 of the swing arm 34 abuts the stem of the fourth appendage 52 which thus acts as a stop, and one set of depressions 64 on the swing arm 34 mates with the ridges 50 on the mounting base 32, thus securing the swing arm 34 in that fully stowed position, preventing the swing arm from accidentally drifting from that fully stowed position. Likewise, while in the fully spanning position (as shown in FIG. 10), the tip 68 of the swing arm 34 abuts the stem of the second appendage 42 which thus acts as a stop, and one set of depressions 64 on the swing arm 34 mates with the ridges 50 on the mounting base 32, thus securing the swing arm 34 in that fully spanning position, preventing the swing arm from accidentally drifting from that fully spanning position.

FIGS. 3–7 show how the support arm 30 is mounted onto the head rail 12 of a vertical blind. Once the swing arm 34 and the mounting base 32 have been assembled together, the swing arm assembly 30 is mounted onto the "U" shaped profile 46 of the head rail 12 (See FIGS. 3, 4, and 5) by sliding the stems of the aligned appendages 42, and 52 between the "legs" of the "U" shaped profile 46. The support arm 30 is pushed or slid along the channel or recess 46 until it reaches the desired location (See FIG. 5), and then pressure is exerted against the first appendage 36 of the base 32 so as to pinch this appendage 36 against the channel 46 (See FIGS. 6 and 7). This pinching action forces the barb 38 at the end of the first appendage 36 of the base 32 to snap into the channel profile 46 with an interference fit, thus locking the support arm 30 in place.

If the support arm 30 needs to be removed or repositioned (See FIGS. 20–23), a tool 72, such as screwdriver blade, is pressed against the side of the mounting base 32 so as to push the mounting base 32 against the head rail 12. This motion moves the first appendage 36 of the base 32 just far enough to the side to free the barb 38 from the channel 46. As the barb pops free, the first appendage 36 springs out of the channel 46, and the mounting base 32 of the support arm 30 slides readily along the channel 46 either to be completely removed from the head rail 12 or to be repositioned along the head rail 12.

FIGS. 8, 9, and 10 show the operation of the support arm 30 as the carrier train opens the blind (retracts) and the support arm 30 has been installed properly. In FIG. 8, the support arm 30 is in the fully stowed position with the major portion of the support arm 30 parallel to the path of travel of the carriers, as the lead carrier 14A is about to engage the support arm 30 to move it to the spanning position. Unlike the other carriers 14, the lead carrier 14A has two engaging posts 74 projecting downwardly. The engaging post 74 adjacent to the side of the head rail 12 on which the support arm 30 is mounted is positioned so it just slides past the side of the support arm 30, except at the ramp 70 and tip 68 of lateral projection, which lie in the direct path of that engaging post 74. When that engaging post 74 reaches the tip 68 of the swing arm's lateral projection, the post 74 makes contact with the tip 68 and pushes against it, as shown in FIG. 8. As the lead carrier 14A continues its travel, the engaging post 74 pushes hard enough against the tip 68 to cause the swing arm 34 to rotate 90 degrees (See FIG. 9). In this new position, the swing arm 34 is spanning across the head rail 12, and the tip 68 has moved so that the engaging post 74 (and therefore also the lead carrier 14A together with the rest of the carrier train) may continue on its travel to retract the vanes of the blind (See FIG. 10). At this point, the tip 68 of the swing arm 34 abuts the stem of the second appendage 42 which thus acts as a stop, and one set of depressions 64 on the swing arm 34 mates with the ridges 50 on the mounting base 32, thus securing the swing arm 34 in that fully spanning position, preventing the swing arm 34 from accidentally drifting from that fully spanning position. In the spanning position, the swing arm 34 is supported at both ends by the head rail channels 46 and helps support the traverse cords 20 and the tilt rod 18 so they will not droop down below the head rail 12 space.

FIGS. 11, 12, and 13 show the operation of the support arm 30 as the carrier train moves in the direction to close the blind (extended), when the support arm 30 has been installed properly. In FIG. 11, the support arm mechanism 30 is in the fully spanning position as the lead carrier 14A is moving to the right to close the vanes of the blind. In FIG. 12, the lead carrier 14A is about to engage the swing arm 34 to move it to the fully stowed position. The engaging post 74 just misses the tip 68 and instead slides into the recess 66 of the swing arm 34. As the lead carrier 14A continues its travel, the engaging post 74 pushes hard enough against the swing arm 34 to cause the swing arm 34 to rotate 90 degrees (See FIG. 13), back to its stowed position. In this new position, the swing arm 34 is fully stowed along the side of the head rail 12, and the recess 66 has moved so that the engaging post 74 (and therefore also the lead carrier 14A together with the rest of the carrier train) may continue on its travel to open the vanes of the blind.

Figure 15:
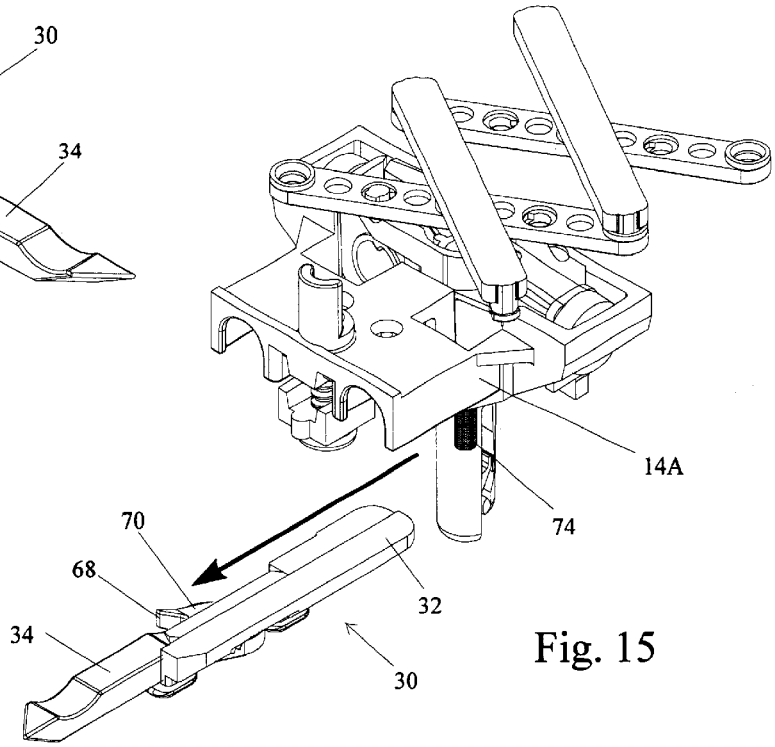
FIG. 15 is a broken away perspective view of the carrier train of FIG. 2 as it extends just prior to encountering the support arm in an incorrect, stowed position when it should be in the spanning position.
Figure 16:
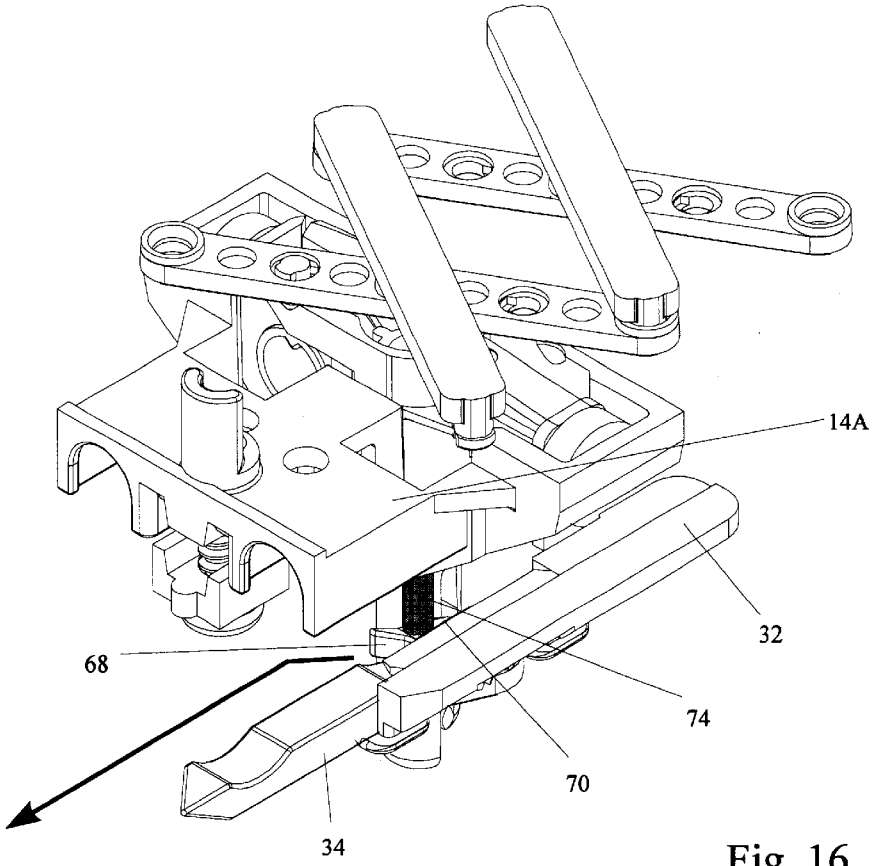
FIG. 16 is the same view as FIG. 15 but with the lead carrier moving further in the closed position, showing how the lead carrier of the carrier train rides up the ramp of the support arm so as to "bypass" the support arm if the arm is incorrectly in the stowed position when it should be in the spanning position.
Figure 20:
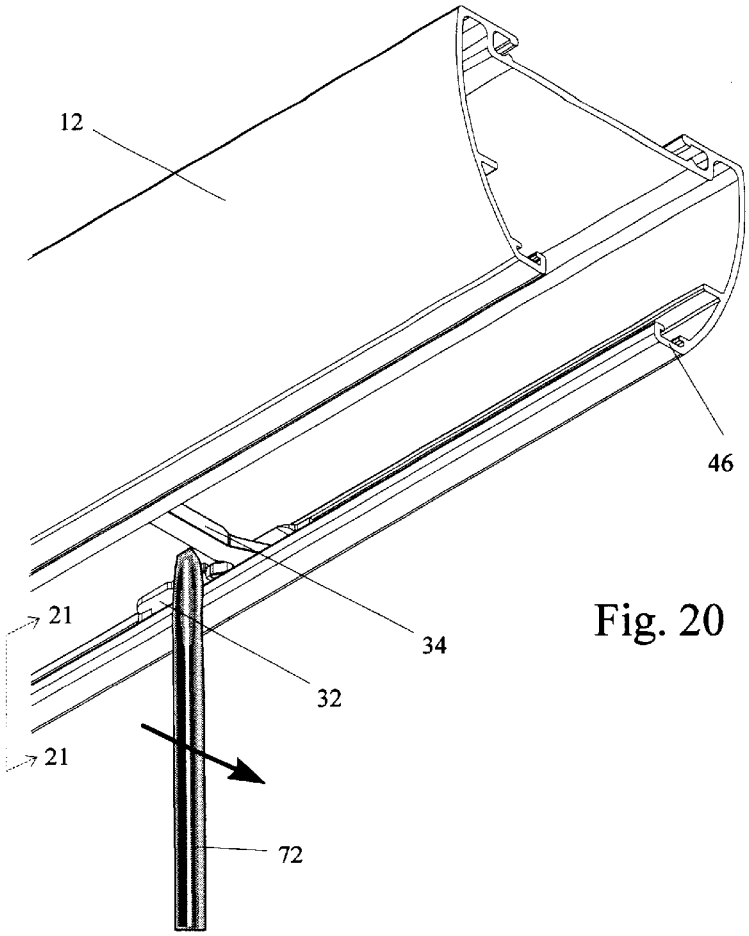
FIG. 20 is a broken away perspective view of the head rail of FIG. 5, showing the placement of a screwdriver in order to unlock the support arm from the head rail.
Figure 21:
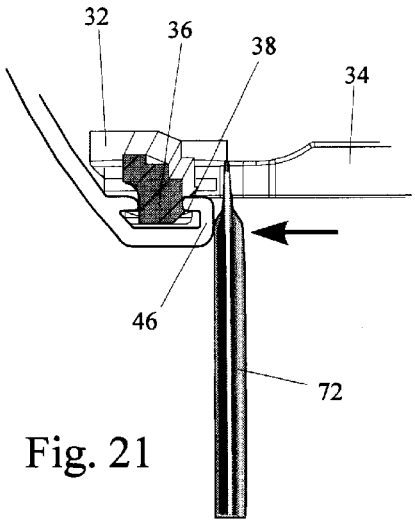
FIG. 21 is a sectional view along line 21—21 of FIG. 20.
Figure 22:
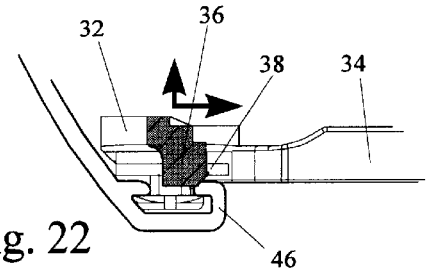
FIG. 22 is the same view as FIG. 21, showing the motion required of the support arm in order to unlock it from the head rail.
Figure 23:
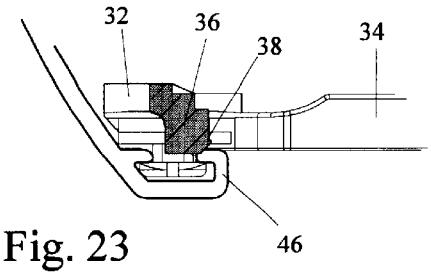
FIG. 23 is the same view as FIGS. 21 and 22, showing the support arm in the now unlocked position, ready to be repositioned or removed.

FIGS. 15 and 16 show the operation of the blind as the carrier train moves to the closed position (extends) and the swing arm 34 is in an incorrect position, being stowed when it should be spanning the head rail 12. In FIG. 15, the swing arm 34 is in the fully stowed position (when it should be spanning) as the lead carrier 14A is moving to close the vanes of the blind. FIG. 16 shows how the engaging post 74 of the lead carrier 14A rides up the ramp 70 of the lateral projection 61 of the swing arm 34 and passes over the lateral projection or short leg 61. The lead carrier 14A thus bypasses the swing arm 34, leaving it in the correct position for the next cycle when the carrier train opens the blind.

FIGS. 17, 18, and 19 show the operation of the blind as the carrier train opens the blind (retracts) and the swing arm 34 is in an incorrect position, spanning across the head rail 12 when it should be fully stowed. In FIG. 17, the swing arm 34 is in the spanning position (when it should be fully stowed) as the lead carrier 14A is moving to open the vanes of the blind. The mounting base 32 of the support arm 30 is securely anchored to the head rail 12, as explained earlier, and the swing arm 34 is securely pivotably mounted to the mounting base 32. The swing arm 34 cannot pivot in the direction in which the lead carrier 14A is moving, because the lateral projection or short leg 61 and the tip 68 abut the stem of the second appendage 42 from the base 32. Therefore, when the carrier hook 15 of the lead carrier 14A hits against the improperly positioned swing arm 34 of the support arm mechanism 30, the lead carrier 14A and the entire carrier train will come to a standstill. Any further pulling by the operator to force the carrier train to traverse will cause the carrier hook 15 to push harder against the swing arm 34. This in turn causes the tip 68 of the swing arm 34 to push harder against the second appendage 42, which causes the second appendage 42 to bind in the track opening 46 and wedge itself to prevent sliding motion of the support arm 30 along the track opening 46.

In order to free the carrier train, the operator will reverse the direction of the carrier train, moving the blind back toward a closed position (See FIG. 18). When this happens, the carrier hook 15 of the next carrier 14 hits against the swing arm 34 but moving in the opposite direction (since the carrier train is now traveling to close the vanes of the blind), and the swing arm 34 swings to the fully stowed position (See FIG. 19), leaving it in the correct position for the next cycle when the carrier train moves to close the blind.

Alternate Embodiment of the Support Arm:

FIGS. 29–49 show an alternate embodiment of a vertical blind which includes an alternate support arm mechanism 130. As in the previous embodiment, this support arm mechanism 130 (See FIG. 38) has a mounting base 132 and a swing arm 134 which is mounted to and pivots about the mounting base 132. Even though the operating concept of this support arm mechanism 130 is very similar to that already described for the support arm 30, there are some differences which are described below.

Figure 46:
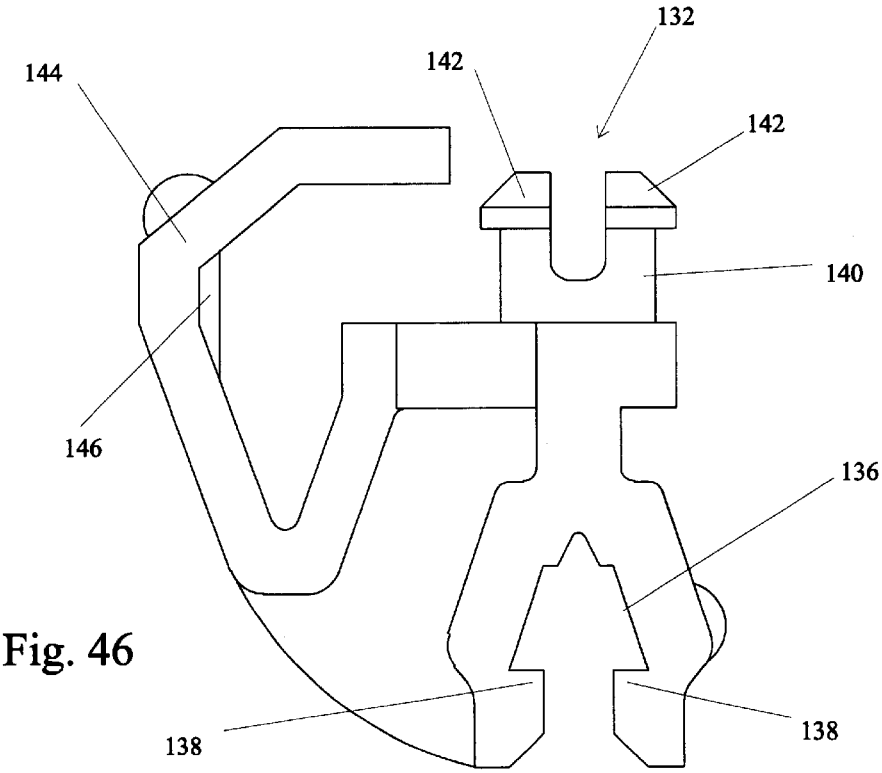
FIG. 46 is a side view of the base portion of the support arm of FIG. 38.
Figure 47:
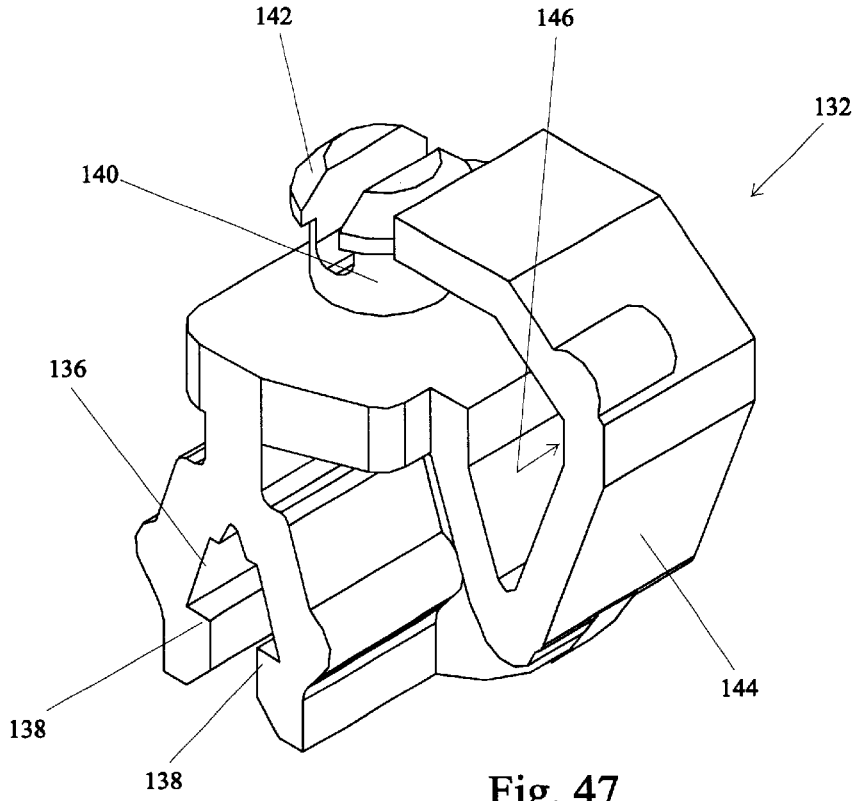
FIG. 47 is a perspective view of the base of FIG. 46.
Figure 48:
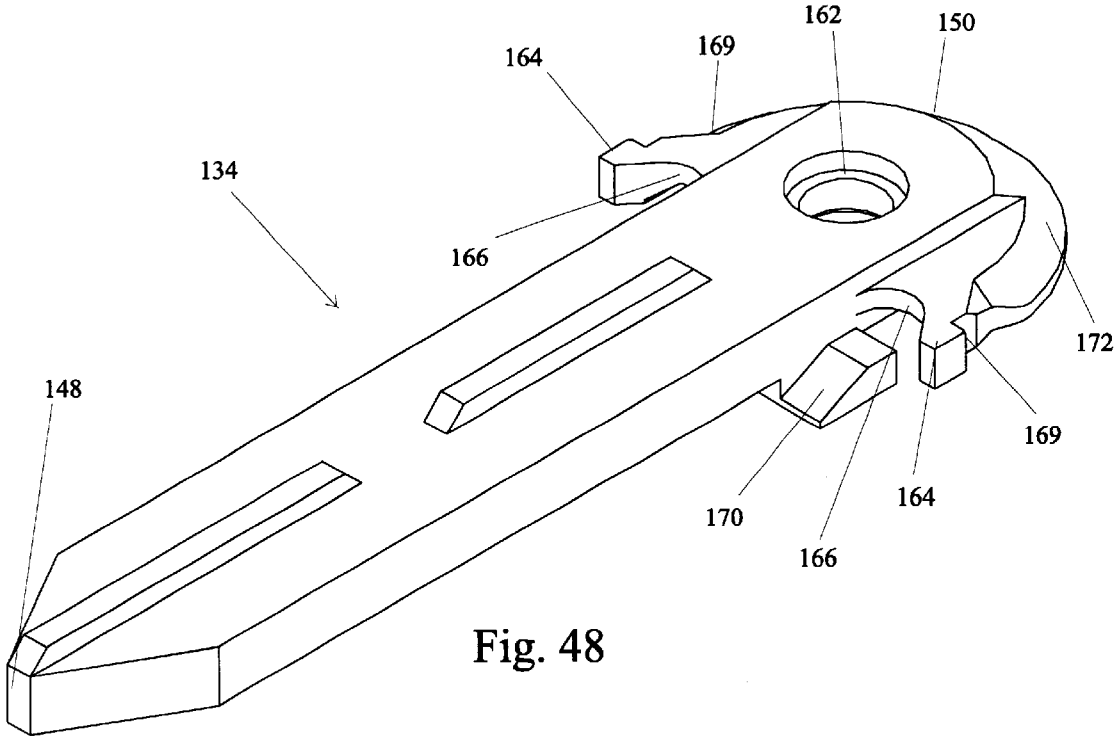
FIG. 48 is a perspective view of the top of the swing arm portion of the support arm of FIG. 38.
Figure 49:
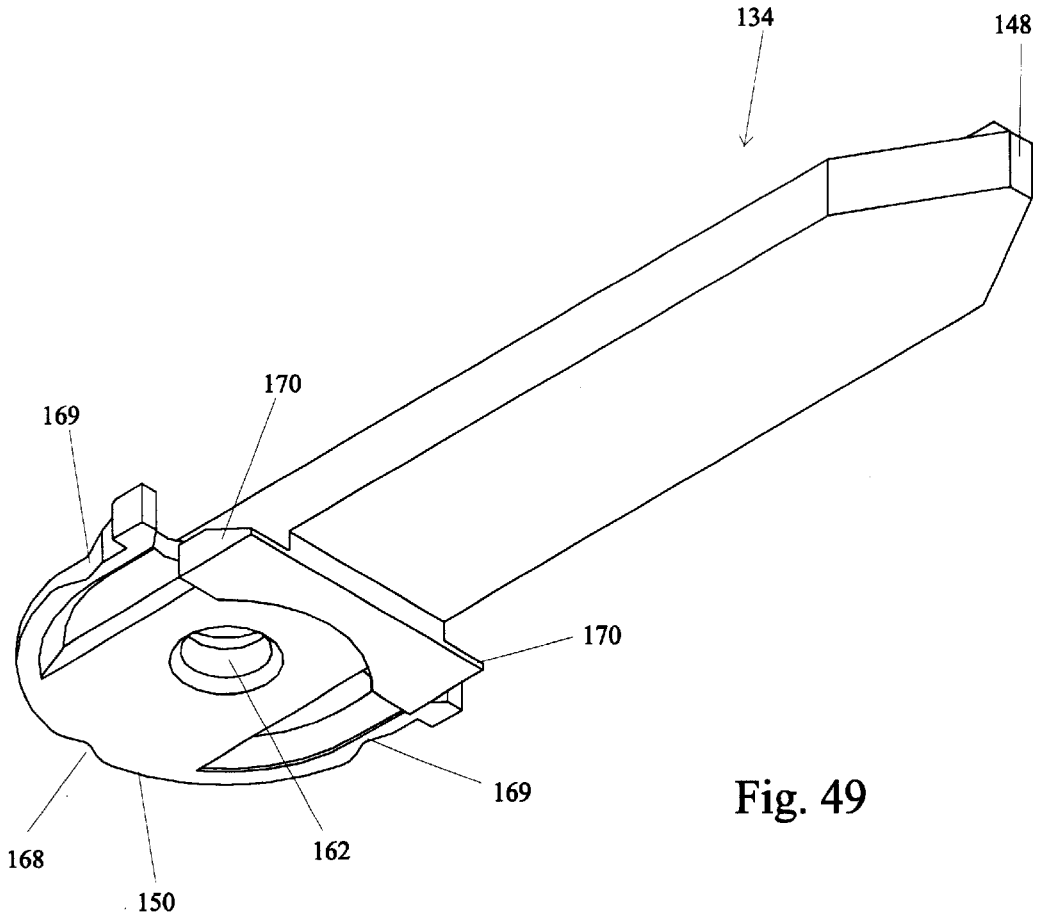
FIG. 49 is a perspective view of the bottom of the swing arm of FIG. 38.

FIGS. 46 and 47 show the mounting base 132 of the support arm 130. This mounting base 132 has a trapezoidal-shaped recess 136 with two barbed ends 138, which are used to mount the base 132 to the head rail 112 as will be explained later. Directly above the recess 136 is a cylindrically-shaped upwardly projecting appendage 140 with flared flanges 142, used for mounting the swing arm 134 onto the mounting base 132 in the same manner as was described for the first embodiment. A flexible, hooked arm 144 projects from one side of the base 132 and is used to further secure the swing arm 134 onto the mounting base 132 and to provide stops for the swing arm 134 in the fully stowed and the spanning positions, as will be described later. The hooked arm 144 has a small rib 146, the purpose of which will also be described later.

The swing arm 134 (See FIGS. 48 and 49) is a straight arm with a pointed end 148 and a rounded end 150 which forms a semi-circle. At the center of the rounded end 150 is a pivot point hole 162 with a diameter slightly larger than the outside diameter of the appendage 140 of the mounting base 132 and slightly smaller than the diameter of the flanged end 142 of the appendage 140. The semicircular edge of the end 150 terminates in laterally projecting tips 164 which define recesses 166. Just in front of these recesses 166 are laterally-extending wedge-shaped ramp projections 170 with a maximum height at the end closest to the recesses 166, and minimum height at the end furthest from the recesses 166, the purpose of which will be explained later. The semi-circular edge of the end 150 also has a small indentation 168 half-way between the two projecting tips 164, as well as indentations 169 just before each of the projecting tips 164. Finally, the top of the semi-circular edge of the end 150 ramps up from a minimum thickness at the outermost edge to a maximum thickness to form a wedge-shaped ramp edge 172, best seen in FIG. 38.

Figure 34:
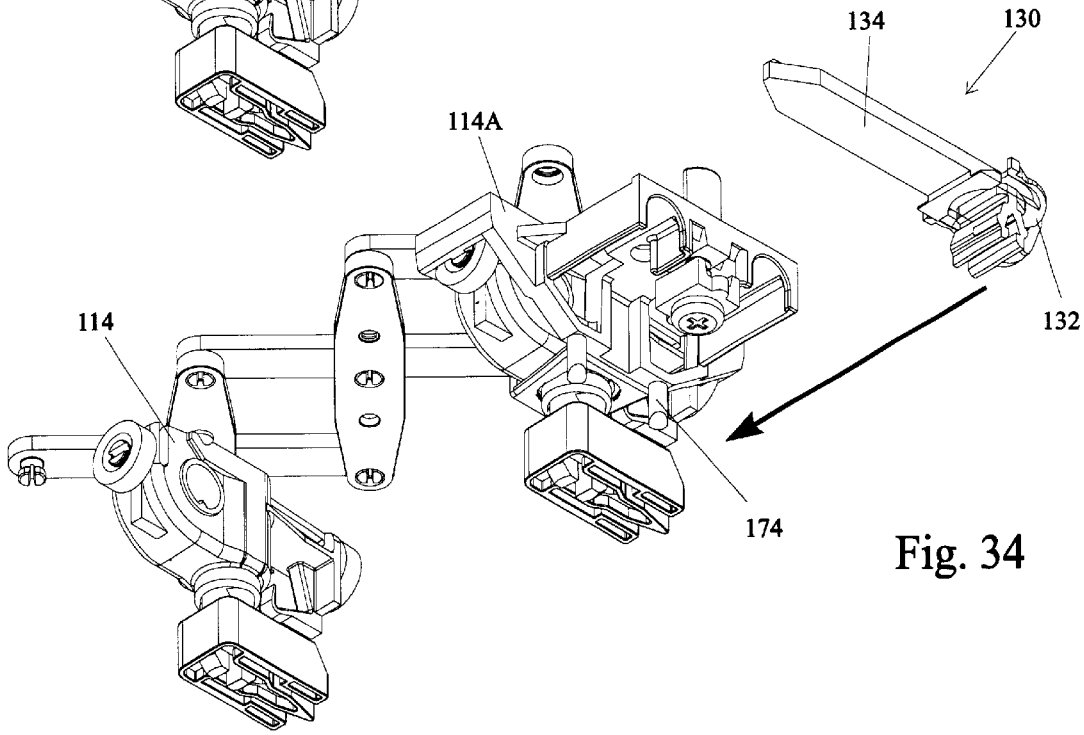
FIG. 34 is the same view as FIGS. 32 and 33, except that the carrier train has traversed open even further, leaving behind the support arm in the activated position, spanning the head rail opening.
Figure 38:
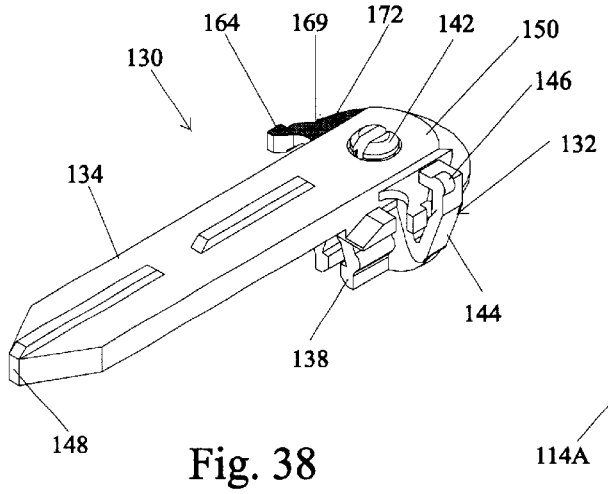
FIG. 38 is a perspective view of the support arm of FIG. 37, clearly showing the ramp used to allow the lead carrier in the carrier train to bypass the support arm when the support arm is incorrectly in the stowed position when it should be in the spanning position

The swing arm 134 is assembled to the mounting base 132 (as shown in FIG. 38) by snapping the appendage 140 of the base 132 through the pivot point hole 162 of the swing arm 134, until the swing arm 134 bottoms out on the base 132 and the flared out flanges 142 snap back out to lock the swing arm 134 in place while still allowing the swing arm 134 to pivot from a fully stowed to a fully spanning position. The flexible, hooked arm 144 snaps over the semi-circular end 150 of the swing arm 134. The radius of the semi-circular end 150 is such that the rib 146 on the hooked arm 144 interferes slightly with the circumference of the semi-circular end 150 except when the rib 146 is aligned with the indentation 168 on the semi-circular end 150 (corresponding to the spanning position of the swing arm 134 as shown in FIG. 34 ), or when the rib 146 is aligned with one of the two indentations 169 proximate one of the projecting tips 164 (corresponding to a fully stowed position of the swing arm 134 as shown in FIG. 38). When the swing arm 134 is in one of these three positions, the rib 146 mates with one of the indentations 168,169 thus acting to secure the swing arm 134 in that position.

Figure 29:
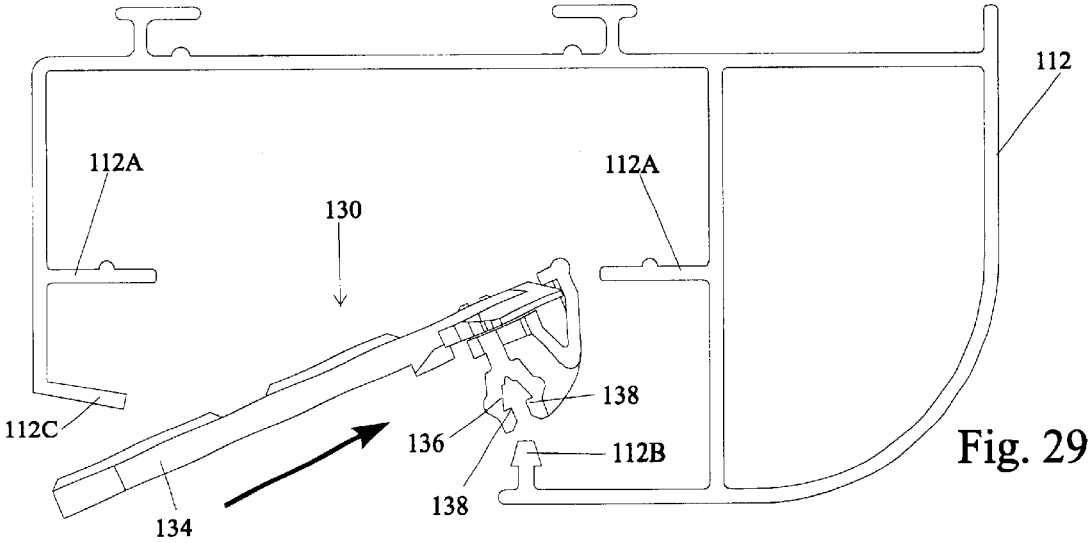
FIG. 29 is an exploded end view depicting the initial step in the installation of a second embodiment of a support arm made in accordance with the present invention into a head rail.
Figure 30:
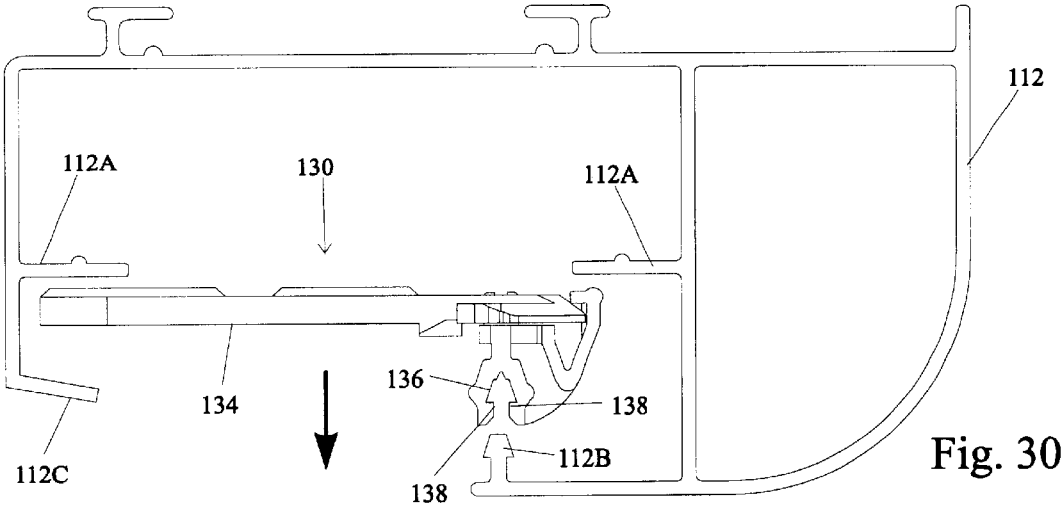
FIG. 30 is the same view as FIG. 29 but with the support arm properly aligned with and ready to be snapped into the profile of the head rail.
Figure 31:
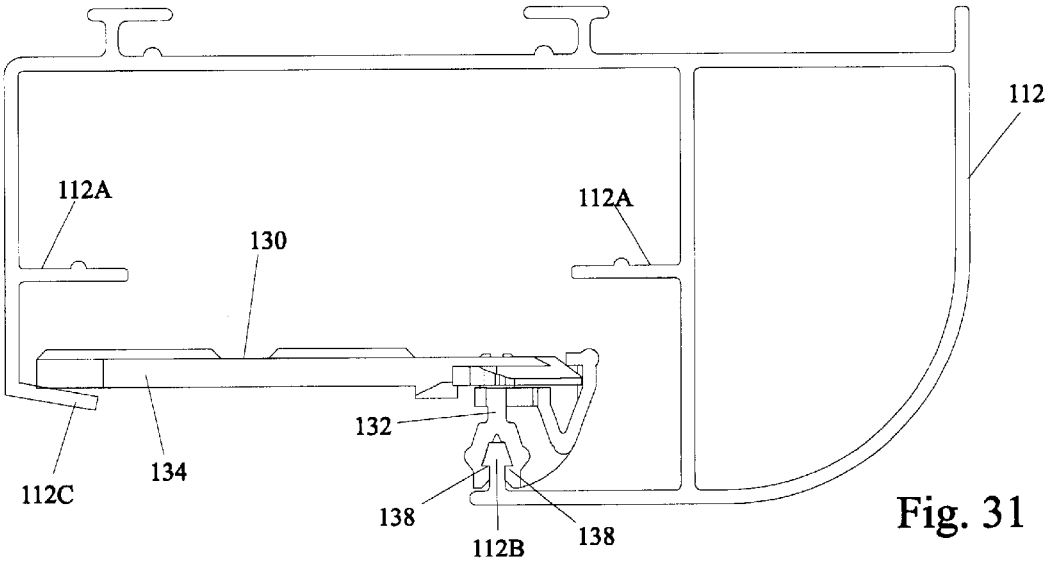
FIG. 31 is the same view as FIGS. 29 and 30 but with the support arm finally installed onto the head rail.

FIGS. 29–31 show the mounting of the support arm 130 onto a head rail 112 which has two brackets 112A on which the carrier train (not shown) rides. A projecting rail 112B is utilized for mounting and locking the support arm 130 on the head rail 112. The support arm 130 is brought into the head rail 112 space as shown in FIG. 29. The support arm 130 is aligned with the head rail 112 such that the trapezoidal-shaped recess 136 on the mounting base 132 is directly above the projecting rail 112B of the head rail 112. The support arm 130 is then pushed down until the mounting base 132 snaps into the projecting rail 112B, where the barbed ends 138 grip and lock the support arm 130 into place on the head rail 112. When the swing arm 134 is in the spanning position, the free end of the swing arm 134 rests on the projecting rail 112C of the head rail 112.

Figure 32:
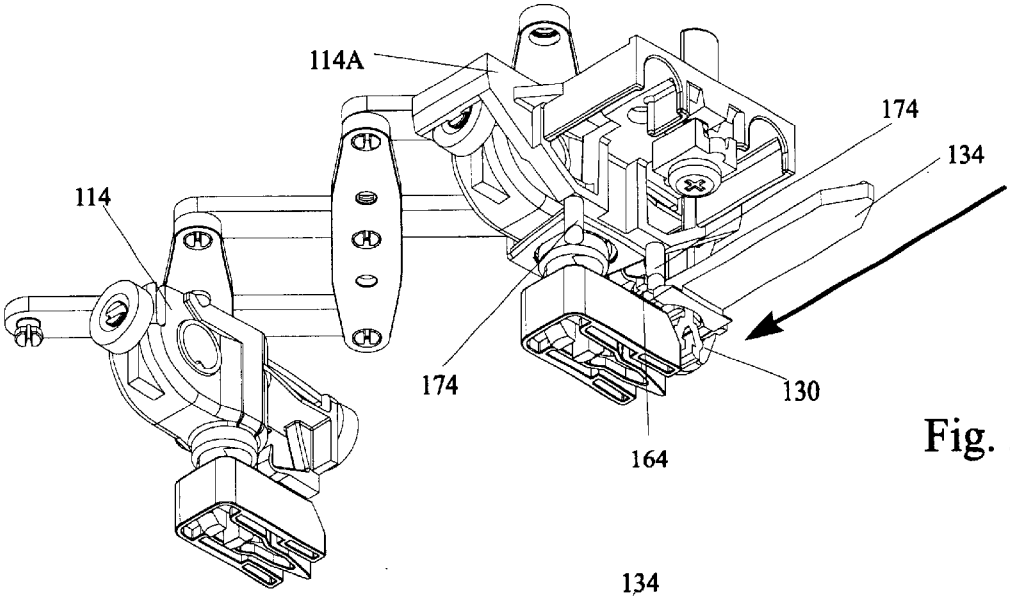
FIG. 32 is a broken away perspective view of the carrier train for the second embodiment arm of FIG. 29, as it traverses open, just prior to activating the support arm.
Figure 33:
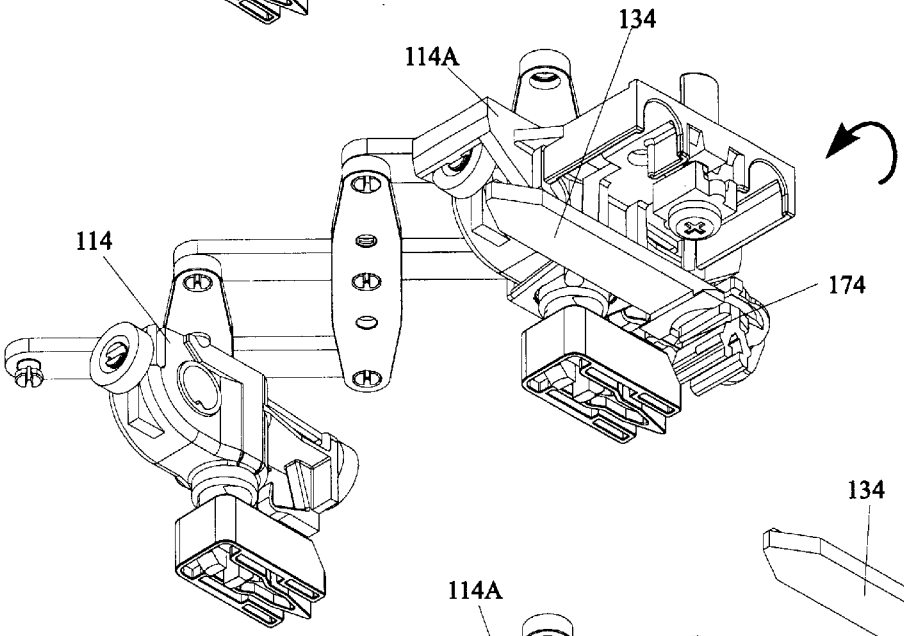
FIG. 33 is a the same view as FIG. 32, except that the carrier train has traversed open enough to activate the support arm such that the support arm spans the head rail.

FIGS. 32, 33, and 34 show the operation of the support arm 130 as the carrier train moves to open the blind and the swing arm 134 is in the proper position. In FIG. 32, the swing arm 134 is in the fully stowed position as the lead carrier 114A is about to engage the swing arm 134 to move it to the spanning position. Unlike the other carriers 114, the lead carrier 114A has two downwardly projecting engaging posts 174. One of these engaging posts 174 is positioned so it just slides past the side of the swing arm 134, except that the tip 164 of the swing arm 134 is in the direct path of that engaging post 174. When that engaging post 174 reaches the tip 164 of the swing arm 134, the post 174 makes contact with the tip 164 and pushes against it. As the lead carrier 114A continues its travel, the engaging post 174 pushes hard enough to cause the swing arm 134 to rotate 90 degrees (See FIG. 33). In this new position, the swing arm 134 is spanning across the head rail 112 and the tip 164 has moved so that the engaging post 174 (and therefore also the lead carrier 1 14A together with the rest of the carrier train) may continue on its travel to draw the vanes of the blind (See FIG. 34). The rear indentation 168 on the edge of the semi-circular end 150 of the swing arm 134 mates with the rib 146 of the hooked arm 144 of the mounting base 132, thus securing the swing arm 134 in that fully spanning position, preventing the swing arm 134 from accidentally drifting from that fully spanning position. In the spanning position, the swing arm 134 remains in position and helps support the traverse cords 20 and the tilt rod 18 so they will not droop down below the head rail 112 space.

Figure 35:
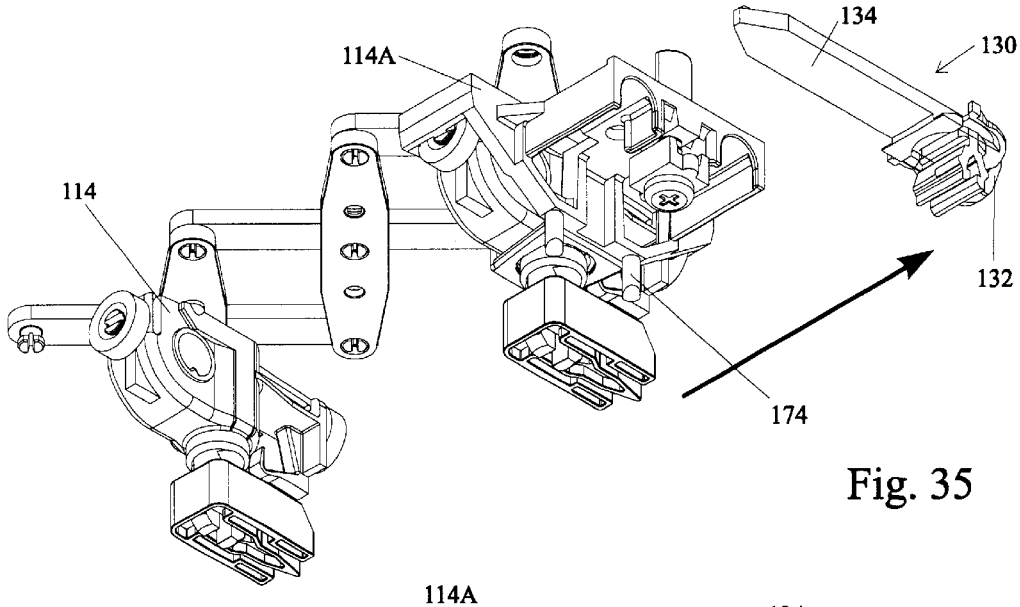
FIG. 35 is the same view as FIG. 34, as the carrier train starts traversing back to the closed position, showing the support arm in the activated position spanning the head rail.
Figure 36:
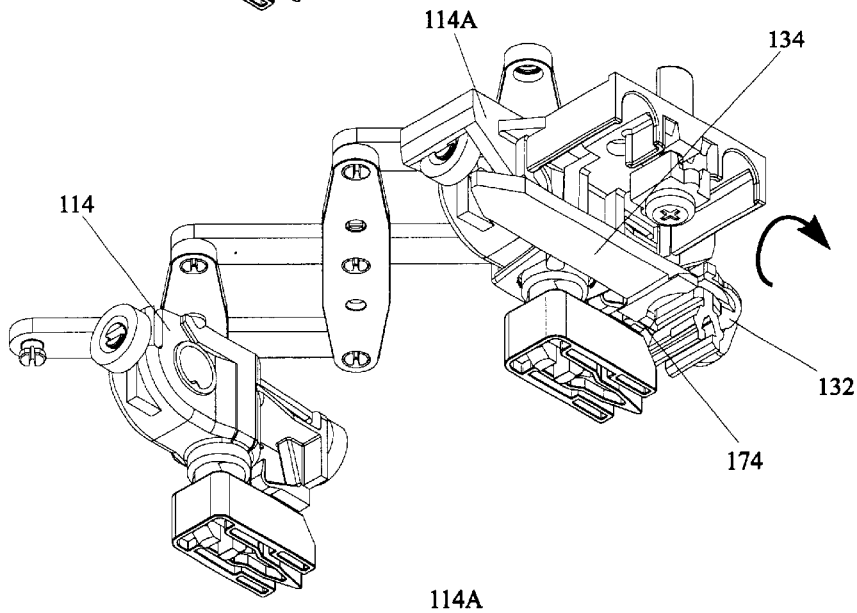
FIG. 36 is the same view as FIG. 35, except that the carrier train has traversed closed to the point where it is just ready to engage the support arm so as to swing it to the stowed position.
Figure 37:
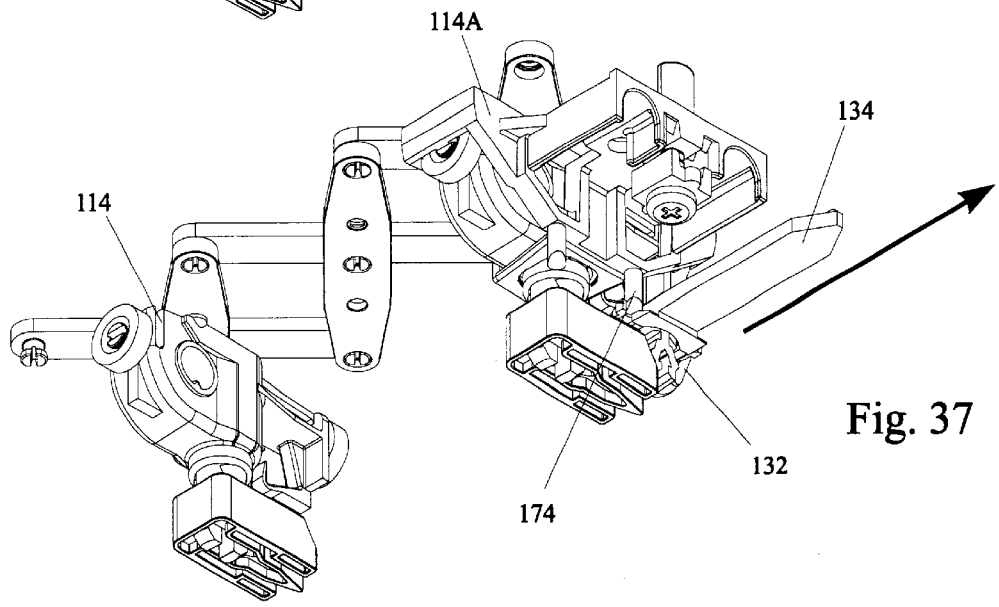
FIG. 37 is the same view as FIGS. 35 and 36, except that the carrier train has traversed closed even further, leaving behind the support arm in the stowed position, no longer spanning the head rail opening.

FIGS. 35, 36, and 37 show the operation of the support arm 130 as the carrier train moves to close the blind and the swing arm 134 is in its proper spanning position. In FIG. 35, the swing arm 134 is in the fully spanning position, as the lead carrier 114A is moving to close the vanes of the blind. In FIG. 36, the lead carrier 114A is about to engage the support arm 130 to move it to the fully stowed position. The nearest engaging post 174 will just miss the tip 164 and will instead slide into the recess 166 of the swing arm 134. As the lead carrier 114A continues its travel, the engaging post 174 pushes hard enough to cause the swing arm 134 to rotate 90 degrees (See FIG. 37). In this new position, the swing arm 134 is fully stowed along the side of the head rail 112, and the side recess 166 engages the rib 146. The engaging post 174 (and therefore also the lead carrier 11 4A together with the rest of the carrier train) may now continue on its travel to close the vanes of the blind.

Figure 39:
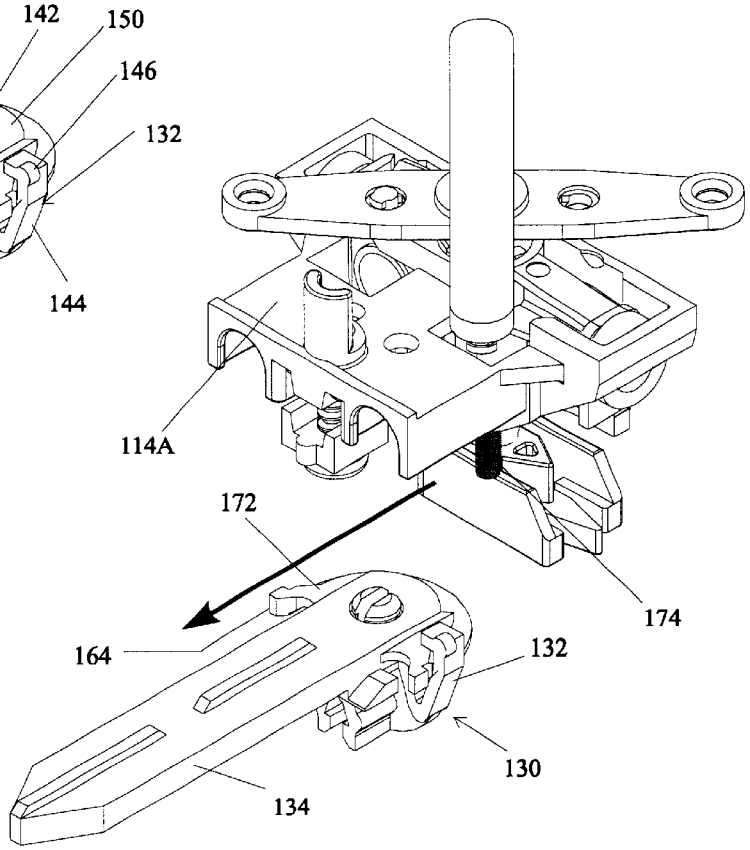
FIG. 39 is a broken away perspective view of the carrier train of FIG. 35 as it traverses closed just prior to encountering the support arm in an incorrect, stowed position, with the major portion of the swing arm facing away from the oncoming carrier train, when the support arm should be in the spanning position.
Figure 40:
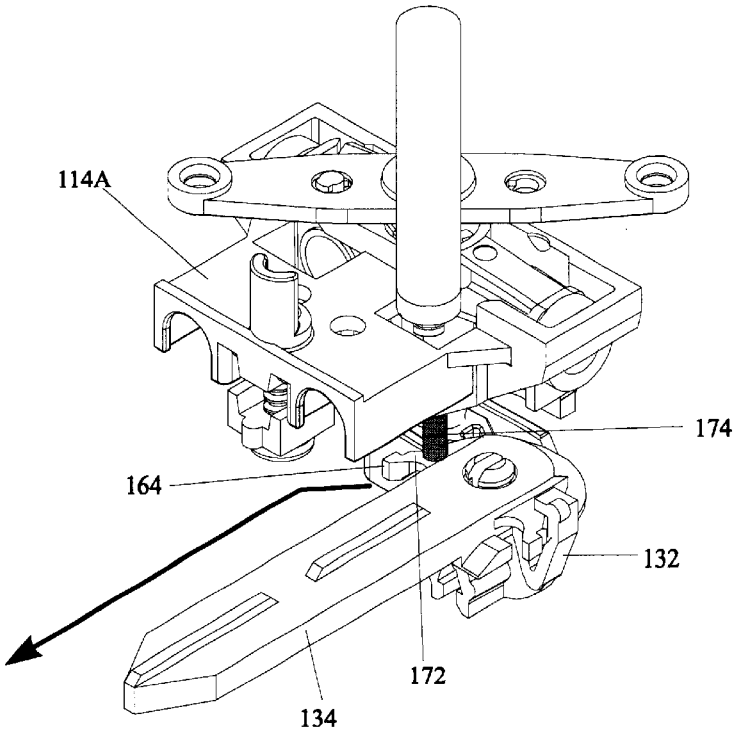
FIG. 40 is the same view as FIG. 39, showing how the lead carrier of the carrier train rides up the ramp of the support arm so as to bypass the support arm when the arm is incorrectly in the stowed position.

FIGS. 39 and 40 show the operation of the support arm 130 as the carrier train moves to close the blind and the swing arm 134 is in an incorrect position, being stowed (with the swing arm 134 pointing in the direction of travel of the lead carrier 114A) when it should be spanning the head rail 112. In FIG. 39, the swing arm 134 is in the fully stowed position (when it should be spanning) as the lead carrier 114A is moving to close the vanes of the blind. FIG. 40 shows how the engaging post 174 of the lead carrier 114A rides up the ramp 172 of the swing arm 134, so that, in fact, the engaging post 174 rides past the projecting tip 164 of the swing arm 134. The lead carrier 114A thus bypasses the support arm 130, leaving it in the correct position for the next cycle when the carrier train moves to open the blind.

FIGS. 41 through 45 show the operation of the support arm 130 as the carrier train moves to close the blind and the swing arm 134 is in an incorrect position, being stowed (with the swing arm 134 pointing in the direction opposite the direction of travel of the lead carrier 114A) when it should be spanning the head rail 112.

Figure 41:
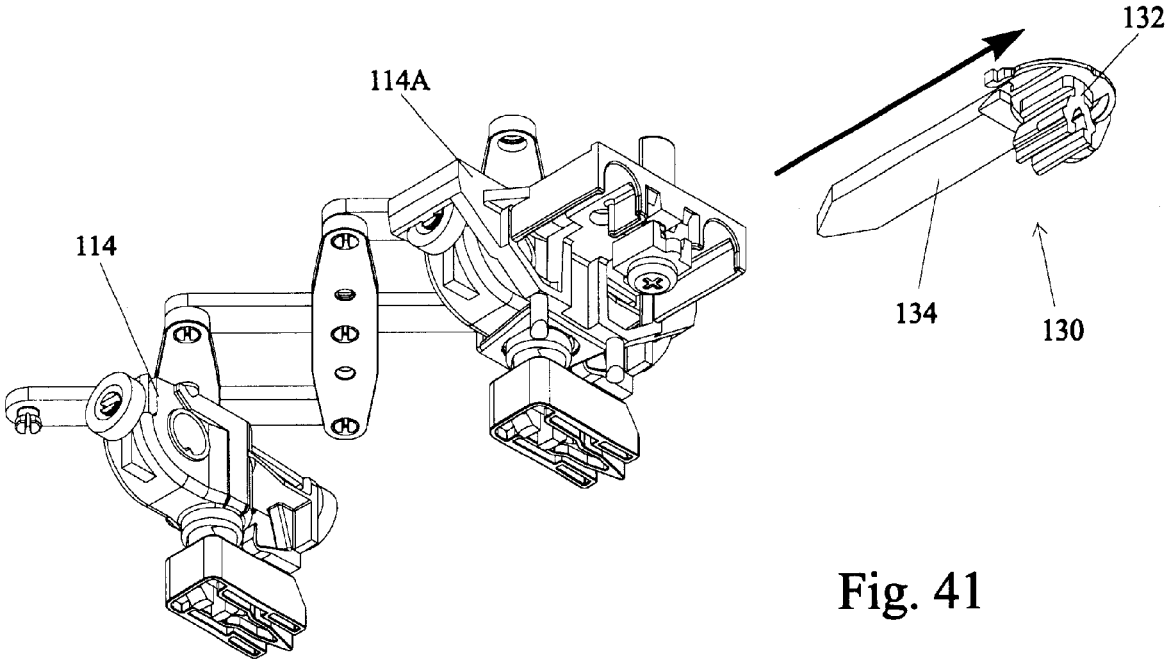
FIG. 41 is a broken away perspective view of the carrier train of FIG. 35 as it traverses closed just prior to encountering the support arm in an incorrect, stowed position, with the major portion of the swing arm facing toward the oncoming carrier train, when the support arm should be in the spanning position.
Figure 43:
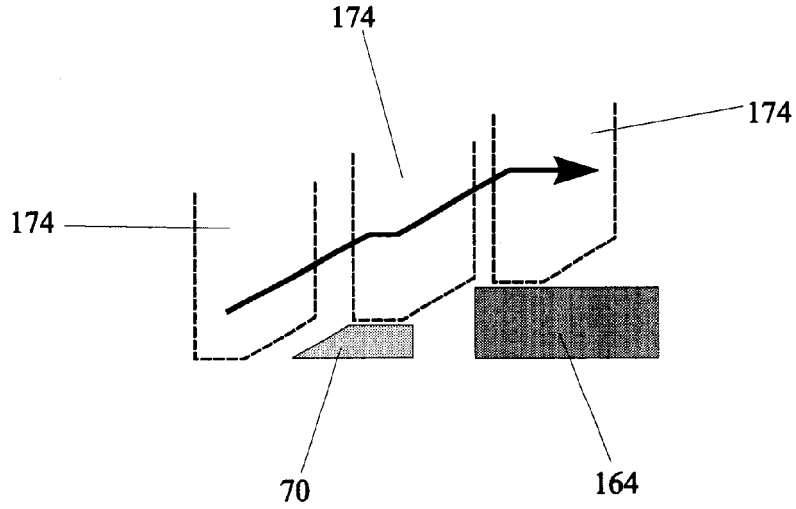
FIG. 43 is a schematic view showing how the lead carrier post of FIG. 42 rides up and over the swing arm so as to bypass it after it has partially engaged it.
Figure 42:
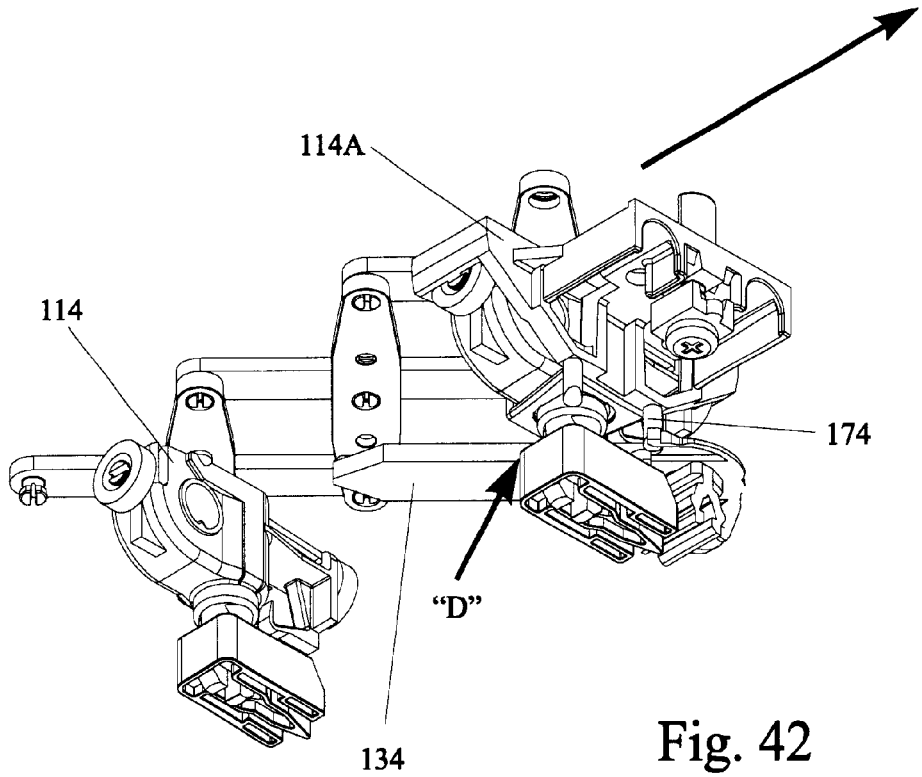
FIG. 42 is the same view as FIG. 41, showing how the lead carrier engages, partially swings, and then bypasses the swing arm which was incorrectly stowed as shown in FIG. 41, readying it for final placement in the correct position by the second carrier coming behind the lead carrier.

In FIG. 41, the carrier train is traversing closed and is about to encounter the incorrectly stowed arm support 130. In FIG. 42, the lead carrier 114A has made contact with the support arm 130. The engaging post 174 of the lead carrier 114A slides up the ramp 170 (See FIG. 48) on the swing arm and begins to swing the swing arm 134 across the head rail 112 space. However, the swing arm 134 will only swing through a 45 degree angle before the leading edge of the swing arm 134 hits the rear of the lead carrier hook (See FIG. 42) at the point labeled "D".The engaging post 174 then rides up and over the swing arm 134 in a step-wise manner, as illustrated in FIG. 43, using the rise in height gained from riding up the ramp 70 to overcome the second height of the projecting arm 164.

FIG. 44 illustrates how the swing arm 134 remains at a 45 degree angle, partially spanning the head rail after the lead carrier 11 4A has passed the support arm 130. The next carrier 114 then engages the swing arm 134 and finishes pivoting it for a full, combined rotation of 180 degrees (approximately 45 degrees caused by the lead carrier 114A, and the balance caused by the next carrier 114), until the support arm 130 is once again in the fully stowed position, but this time facing in the correct direction so it may be engaged to the spanning position the next time the carrier train traverses open.

Finally, the situation may arise where the swing arm 134 is in the spanning position when it should be in the fully stowed position. In this instance, regardless of the direction of travel of the carrier train, the first carrier 114, 114A to come in contact with the swing arm 134 pushes the swing arm 134 to a fully stowed position either into the correct orientation (with the swing arm 134 pointing in the direction of the carrier train in the closed position) or into an incorrect orientation (with the swing arm 134 pointing in the direction of the carrier train in the open position). In the first instance, the swing arm 134 is correctly oriented for when the carrier train traverses to open the blind. In the second instance, the swing arm 134 is incorrectly oriented but will be correctly reoriented via the mechanism described in the previous three paragraphs above (and illustrated in FIGS. 41–45).

Figure 52:
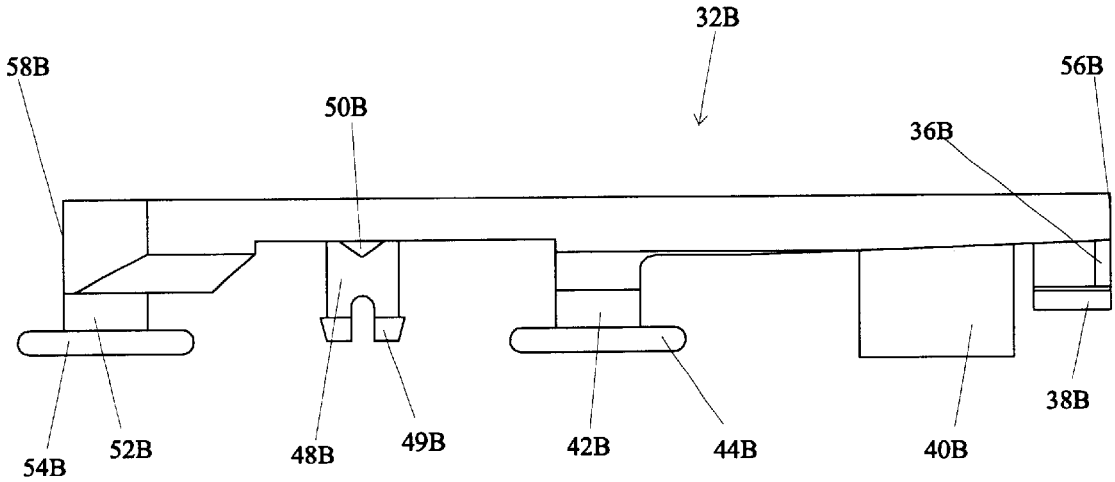
FIG. 52 is a side view of the base of FIG. 50.
Figure 53:
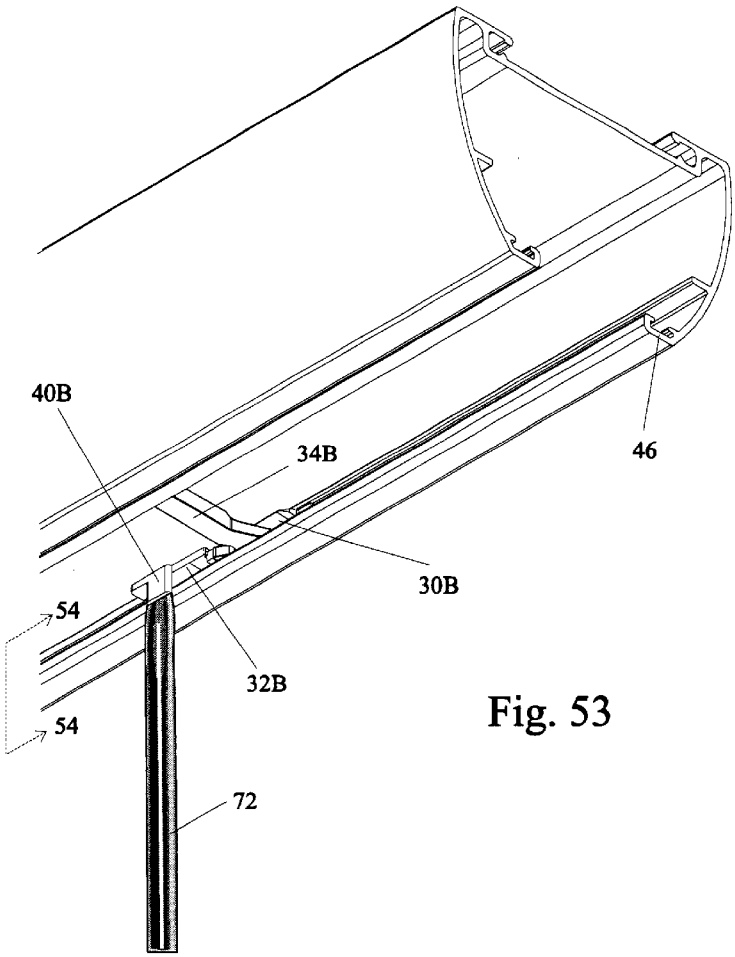
FIG. 53 is a broken away perspective view of a head rail, showing the placement of a screwdriver in order to unlock the support arm from the head rail when using the alternate embodiment base portion of FIG. 50.
Figure 54:
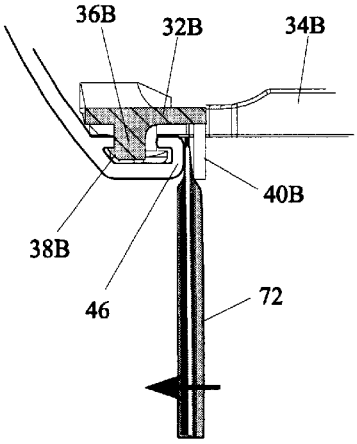
FIG. 54 is a sectional view along line 54—54 of FIG. 53.
Figure 55:
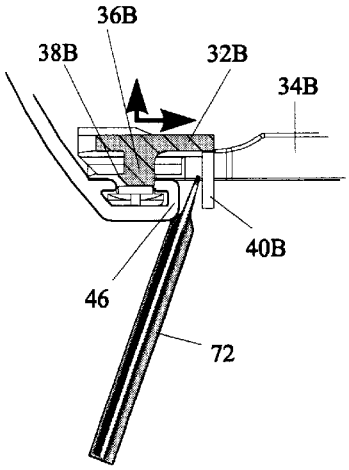
FIG. 55 is the same view as FIG. 54, showing the motion required of the screwdriver and the support arm in order to unlock it from the head rail; and, FIG. 56 is the same view as FIGS. 54 and 55, showing the support arm in the now unlocked position, ready to be repositioned or removed.
Figure 56:
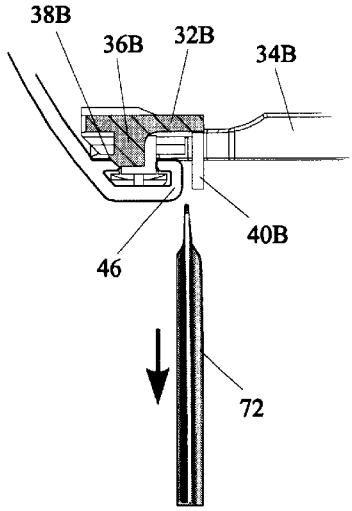

FIGS. 50–52 depict an alternate embodiment of a mounting base 32B which may be used instead of the mounting base 32 of the support arm 30 of FIG. 14. This alternate mounting base 32B is identical to the mounting base 32 already described, except it has one more appendage 40B, and the barb 38B on the first appendage 36B is on the opposite side as compared to the barb 38 on the first appendage 36 of the mounting base 32. Since these bases 32, 32B are practically identical, we will keep the same number designations for both, except that the number designations for the alternate base 32B will all be followed by the letter "B" to differentiate them from the mounting base 32 already described.

The extra appendage 40B is the only appendage which is not aligned with the other appendages. Instead, it sits to one side of the mounting base 32B and just slightly forward of the first appendage 36B, and its purpose, as will be explained in more detail later, is to provide a surface against which to pry a tool, such as a screwdriver, in order to release the lock provided by the barb 38B of the first appendage 36B, in the event that it becomes desirable to relocate or remove the support arm 30B from the head rail 12. This extra appendage 40B and its function in releasing the support arm 30B from the head rail 12, and the location of the barb 38B on the first appendage 36B are the only differences between this alternate embodiment of the support arm 30B and the previously described support arm 30. The assembly, installation, and operation remain identical; the only difference is in the removal or relocation of the support arm 30B as is described below.

If the support arm 30B needs to be removed or repositioned (See FIGS. 53–56), a tool 72, such as screwdriver blade, is inserted between the channel 46 and the extra appendage 40B of the mounting base 32B. The tool 72 is used to pry the mounting base 32B away from the channel 46 just enough to allow the barb 38B of the first appendage 36B to slide out from the channel 46 and thus disengage the locking mechanism. The support arm 30B is now free to slide along the channel 46 either to be completely removed from the head rail 12 or to be repositioned along the head rail 12.

It will be obvious to those skilled in the art that modifications may be made to the embodiments described above without departing from the scope of the present invention.

What is claimed is:

1. A mechanism for a vertical blind transport system, comprising:

a head rail;

a lead carrier of a carrier train mounted on said head rail, said lead carrier including at least one engaging pin, said carrier train being movable along said head rail and defining a traversing open direction and a traversing closed direction;

a support arm mechanism, including a mounting base mounted on said head rail and a swing arm pivotally mounted to said mounting base, wherein said engaging pin contacts said swing arm and moves said swing arm from a stowed position to a spanning position when said carrier train travels in the traversing open direction and from the spanning position back to the stowed position when said carrier train travels in the traversing closed direction, and wherein said swing arm has an upper surface which defines a ramp, and said engaging pin bypasses said swing arm by riding over said ramp when said swing arm is incorrectly in the stowed position.

2. A mechanism for a vertical blind transport system, comprising:

a head rail;

a carrier train including a plurality of carriers mounted on said head rail for movement along said head rail, at least one of said carriers being a lead carrier and having at least one engaging pin;

a support arm mechanism, including a mounting base mounted on said head rail and a swing arm pivotally mounted to said base, wherein said engaging pin moves said swing arm to a spanning position when said carrier train traverses open and to a stowed position when said carrier train traverses closed, and further comprising means for said carrier train to interact with said swing arm to reset said swing arm to a correct position when said swing arm is in an incorrect position.

3. A mechanism for a vertical blind transport system as recited in claim 2, and further comprising:

means for releasably securing said base to said head rail.

4. A mechanism for a vertical blind transport system as recited in claim 3, wherein said swing arm includes at least one lateral projection which catches on said engaging pin of said lead carrier to move said swing arm from said stowed position to said spanning position when said carrier train is retracting to open said blind.

5. A mechanism for a vertical blind transport system as recited in claim 4, wherein said swing arm includes a ramp which provides a path for said engaging pin of said lead carrier to bypass said swing arm when said swing arm is in said stowed position and said carrier train is extending to close said blind.

6. A mechanism for a vertical blind transport system as recited in claim 3, wherein said means for releasably securing said base to said head rail includes an elongated recess in said head rail; at least one sliding projection extending from said mounting base which is received by said recess with a sliding fit, and at least one locking projection extending from said mounting base which is received by said recess with an interference fit.

7. A transport system for a vertical blind, comprising:

an elongated head rail defining a substantially open bottom;

at least one carrier mounted on said head rail for movement along said head rail, said carrier including an engaging pin which, as it moves with said carrier, defines a path of travel;

at least one swing arm mechanism mounted on said head rail, said swing arm mechanism including a mounting base portion mounted on said head rail and a swing arm pivotably mounted on said mounting base at a pivot point, wherein said swing arm includes a major portion and a lateral projection, and said swing arm is pivotable to a spanning position, in which said major portion extends substantially across said open bottom, and to a stowed position, in which said major portion extends substantially parallel to said path of travel and said lateral projection extends into said path of travel, said swing arm having an upper surface and a lower surface, wherein the upper surface of said lateral projection defines a ramp, and wherein, when the swing arm is in the stowed position and the carrier engaging pin contacts the lateral projection while travelling in a first direction along the path of travel, it causes the swing arm to pivot to the extended position, and, when the swing arm is in the stowed position and the carrier contacts the lateral projection while travelling in an opposite direction along the path of travel, the carrier engaging pin rides along said ramp to bypass said swing arm mechanism.

8. A transport system for a vertical blind as recited in claim 7, wherein said head rail defines an elongated slot, and said mounting base includes at least one sliding projection which is received in said elongated slot with a sliding fit and at least one locking projection which is received in said elongated slot with an interference fit to releasably lock said mounting base on said head rail.

9. A transport system for a vertical blind as recited in claim 7, wherein said ramp pivots out of said path of travel when said swing arm pivots to the spanning position and pivots into said path of travel when said swing arm pivots to the stowed position.

* * * * *